US007011389B2

(12) United States Patent
Edamura et al.

(10) Patent No.: US 7,011,389 B2
(45) Date of Patent: Mar. 14, 2006

(54) INK JET PRINTING APPARATUS

(75) Inventors: Tetsuya Edamura, Kanagawa (JP); Hiroshi Tajika, Kanagawa (JP); Yuji Konno, Kanagawa (JP); Yuji Hamasaki, Kanagawa (JP); Norihiro Kawatoko, Kanagawa (JP); Takayuki Ogasahara, New York, NY (US); Atsuhiko Masuyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 137 days.

(21) Appl. No.: 10/214,106

(22) Filed: Aug. 8, 2002

(65) Prior Publication Data

US 2003/0063152 A1 Apr. 3, 2003

(30) Foreign Application Priority Data

Aug. 10, 2001 (JP) ..... 2001-245031
Jul. 25, 2002 (JP) ..... 2002-217090

(51) Int. Cl.
*B41J 2/165* (2006.01)

(52) U.S. Cl. ..... 347/36
(58) Field of Classification Search ..... 347/35, 347/36
See application file for complete search history.

(56) References Cited

U.S. PATENT DOCUMENTS 4,701,771 A * 10/1987 Ikeda ..... 347/36
5,172,140 A 12/1992 Hirabayashi et al. ..... 346/140
5,291,227 A * 3/1994 Suzuki ..... 347/104
5,745,134 A * 4/1998 Hirabayashi et al. ..... 347/36
5,997,129 A * 12/1999 Matsuhashi ..... 347/35
6,168,259 B1 * 1/2001 Capurso ..... 347/36
6,174,042 B1 1/2001 Kobayashi et al. ..... 347/23
6,239,817 B1 * 5/2001 Meyer ..... 347/36
6,457,803 B1 * 10/2002 Ohkoda ..... 347/36
6,709,088 B1 * 3/2004 Hayakawa et al. ..... 347/31
2002/0003554 A1 1/2002 Hayakawa et al. ..... 347/31

FOREIGN PATENT DOCUMENTS

| | | |
|---|---|---|
| EP | 1 000 754 | 5/1700 |
| EP | 0 707 973 | 4/1996 |
| EP | 1 059 168 | 12/2000 |
| KR | 97-12410 | 4/1997 |

* cited by examiner

*Primary Examiner*—K. Feggins
*Assistant Examiner*—Julian D. Huffman
(74) *Attorney, Agent, or Firm*—Fitzpatrick, Cella, Harper & Scinto

(57) ABSTRACT

An ink jet recording apparatus can reduce waste ink produced in marginless printing caused by overflow from an ink absorber. To realize this, each time the marginless printing is executed, the volume of waste ink produced by the marginless printing is cumulatively added up in order to control a total volume of the waste ink. The waste ink volume to be added up is determined by at least the kind of print medium or the print mode.

12 Claims, 24 Drawing Sheets

INK JET PRINTING APPARATUS

This application is based on Japanese Patent Application Nos. 2001-245031 filed Aug. 10, 2001 and 2002-217090 filed Jul. 25, 2002, the contents of which are incorporated hereinto by reference.

BACKGROUND OF THE INVENTION

1. Field of the Invention

The present invention relates to an ink jet printing apparatus for printing an image on a print medium by ejecting ink from a print head and more particularly to an ink jet printing-apparatus capable of performing a margin-free printing (or marginless printing) that prints on a print medium without leaving blank margins at ends of the print medium.

2. Description of the Related Art

In addition to an ink that adheres to a print medium for image making, normally a waste ink is also produced in an ink jet printing apparatus that is absorbed and held in an apparatus body. This waste ink is produced when performing such recovery operations as a preliminary ejection and a print head nozzle suction and when performing a printing operation without leaving blank margins at ends of the print medium (this type of printing is hereinafter referred to as a marginless printing).

(Preliminary Ejection)

In nozzles that have not performed ink ejection for many hours, ink evaporation from nozzle ends causes property changes in the ink, which in turn may result in ejection failures. To avoid this, an ink ejection not directly associated with the image making is performed at a preliminary ejection ink receiver provided outside the printing area. The preliminary ejection ink receiver typically consists of a sponge that absorbs ink and is connected with a waste ink absorber provided in the apparatus body. The preliminary ejection may also be done-to flush out mixed color inks from the nozzles.

(Print Head Nozzle Suction)

If the print head is left unused for a long period of time, bubbles may accumulate in a head liquid chamber. When a large bubble is produced, the bubble may cover the nozzle portion, rendering it unable to eject properly. Hence, in the ink jet printer, it is necessary to measure the time that has elapsed from the last head nozzle suction operation and perform nozzle suction operations at predetermined time intervals. This suction operation involves hermetically closing the head nozzle portion with a cap that communicates with a pump and operating the pump to reduce a pressure and thereby draw out ink from the head nozzles. At this time, increasing a magnitude of pressure reduction to draw out ink with a strong suction force can also discharge bubbles from the liquid chamber at the same time. The ink thus drawn out is pumped to a waste ink absorber in the apparatus body where it is absorbed and retained.

(Marginless Printing)

When performing a marginless printing (with no blank margins left at ends of the print medium), print data is used that is to be printed over an area larger than the medium and an ink ejection operation is done over and slightly beyond the print medium. Therefore, a part of the ejected ink does not land on the print medium but on a platen outside the print medium. Thus, an ink absorber (platen ink absorber) that collects the ink ejected outside the print medium is often provided In a predetermined range of the platen where excess ink may land, in order to prevent the platen from being contaminated by the excess ink.

An execution of the marginless printing as described above also produces a waste ink. Thus, the waste ink is produced not only during the recovery operation such as preliminary ejection and nozzle suction but also during the marginless printing. Therefore, in a conventional configuration that manages only the amount of waste ink generated by the recovery operation despite the fact that the waste ink is also generated during the marginless printing, the inventors have found the following problems. That is, since the configuration that manages only the amount of waste ink produced by the recovery operation cannot know the amount of waste ink from the marginless printing, it cannot check an ink overflow from the ink absorber caused by the waste ink produced by the marginless printing, thus increasing the probability of stain inside of the apparatus To describe in more concrete terms, in a first configuration in which an ink absorber (waste ink absorber) for collecting a waste ink produced by the recovery operation and an ink absorber (platen ink absorber) for collecting a waste ink generated by the marginless printing are not communicated with each other, because all of the waste ink from the marginless printing is retained in the platen ink absorber, it is necessary to manage the amount of waste ink produced by the marginless printing so that the total amount of ink delivered to the platen ink absorber does not exceed the absorption limit of the platen ink absorber. Without this management, the ink overflow from the platen ink absorber cannot be prevented, which will increase the probability of platen stain.

On the other hand, in a second configuration in which the ink absorber (waste ink absorber) for collecting the waste ink produced by the recovery operation and the ink absorber (platen ink absorber) for collecting the waste ink generated by the marginless printing are communicated with each other, the waste ink from the marginless printing is collected through the platen ink absorber to the waste ink absorber where it is held. That is, the waste ink from the marginless printing is held in the waste ink absorber along with the waste ink from the recovery operation. Thus, in this second configuration, the total amount of waste ink in the waste ink absorber must be managed by taking into consideration the amount of waste ink from the marginless printing as well as the amount of waste ink from the recovery operation so that the total amount of ink held in the waste ink absorber does not exceed its absorption limit. As described above, unless the amount of waste ink from the marginless printing is managed along with the amount of waste ink from the recovery operation, the ink overflow from the waste ink absorber cannot be prevented, which in turn leads to an increased probability of stain inside the apparatus.

As can be seen from the above, in an ink jet printing apparatus capable of marginless printing, it is desired that the amount of waste ink produced during the marginless printing be managed for preventing the ink overflow from the ink absorber and for reducing a probability of stain inside the apparatus. Further, it is also desired that the management of the amount of waste ink produced by the marginless printing be realized in as simple a construction as possible without requiring a complicated control process.

SUMMARY OF THE INVENTION

An object of the present invention is to provide an ink jet printing apparatus capable of controlling a waste ink volume produced by the marginless printing and thereby reducing to a sufficiently low level a possibility of the waste ink overflowing from an ink absorber.

According to one aspect, the present invention provides an ink jet printing apparatus for performing a marginless printing at end portions of a print medium supported on a platen by ejecting ink from a print head onto an overrunning area outside the end portions of the print medium, the ink jet printing apparatus comprising: an ink receiver for receiving waste ink ejected onto the overrunning area outside the end portions of the print medium; and waste ink volume accumulating means for cumulatively adding a volume of waste ink ejected to the ink receiver; wherein the waste ink volume accumulating means adds up a value corresponding to the volume of waste ink produced by the marginless printing performed on one page of each time the marginless printing is executed on one page of print medium.

Another aspect of the present invention provides an ink jet printing apparatus for performing a marginless printing at end portions of a print medium supported on a platen by ejecting ink from a print head onto an overrunning area outside the end portions of the print medium, the ink jet printing apparatus comprising: an ink receiver for receiving waste ink ejected onto the overrunning area outside the end portions of the print medium; and waste ink volume accumulating means for cumulatively adding a value corresponding to a volume of waste ink ejected to the ink receiver during the marginless printing performed on the print medium each time the marginless printing is executed on the print medium; wherein the waste ink volume accumulating means adds up a value corresponding to the volume of waste ink which is determined based on at least one of a kind of print medium, a print mode and a size of print data used for the printing.

Still another aspect of the present invention provides an ink jet printing apparatus for performing a marginless printing at end portions of a print medium supported on a platen by ejecting ink from a print head onto an overrunning area outside the end portions of the print medium, the ink jet printing apparatus comprising: an ink receiver for receiving waste ink ejected onto the overrunning area outside the end portions of the print medium; and waste ink volume accumulating means for cumulatively adding a value corresponding to a volume of waste ink ejected to the ink receiver during the marginless printing performed on the print mediums each time the marginless printing is executed on the print mediums; wherein the waste ink volume accumulating means adds up a first value corresponding to the volume of waste ink when a kind of print medium used for the printing is a first print medium and, when it is a second print medium different from the first print medium, adds up a second value corresponding to the volume of waste ink which is different from the first value.

Yet another aspect of the present invention provides an ink jet printing apparatus for performing a marginless printing at end portions of a print medium supported on a platen by ejecting ink from a print head onto an overrunning area outside the end portions of the print medium, the ink jet printing apparatus comprising: an ink receiver for receiving waste ink ejected onto the overrunning area outside the end portions of the print medium; and waste ink volume accumulating means for cumulatively adding a value corresponding to a volume of waste ink ejected to the ink receiver during the marginless printing performed on the print mediums each time the marginless printing is executed on the print mediums; wherein the waste ink volume accumulating means adds up a first value corresponding to the volume of waste ink when a print mode used for the printing is a relatively fast first mode and, when it is a relatively slow second mode, adds up a second value corresponding to the volume of waste ink which is different from the first value.

A further aspect of the present invention provides an ink jet printing apparatus for performing a marginless printing at end portions of a print medium supported on a platen by ejecting ink from a print head onto an overrunning area outside the end portions of the print medium, the ink jet printing apparatus comprising: an ink receiver to receive waste ink ejected onto the overrunning area outside the end portions of the print medium; and a waste ink volume accumulating means to cumulatively add a value corresponding to a volume of waste ink ejected to the ink receiver during the marginless printing performed on the print mediums each time the marginless printing is executed on the print mediums; wherein the waste ink volume accumulating means adds up a first value corresponding to the volume of waste ink when a size of print data used for the printing is a first size and, when it is a second size different from the first size, adds up a second value corresponding to the volume of waste ink which is different from the first value.

The invention having the construction described above can reduce an ink (a waste ink) overflow from the ink absorber cased by the waste ink produced by a marginless printing.

The above and other objects, effects, features and advantages of the present invention will become more apparent from the following description of embodiments thereof taken in conjunction with the accompanying drawings.

DETAILED DESCRIPTION OF PREFERRED EMBODIMENTS (Basic Construction)

First, a basic construction of an ink jet printing apparatus as one embodiment of the present invention will be described by referring to FIG. 1 through FIG. 10.

In this specification, a word "print" (or "record") refers to not only forming significant information, such as characters and figures, but also forming images, designs or patterns on printing medium and processing media, whether the information is significant or insignificant or whether it is visible so as to be perceived by humans.

The word "print medium" or "print sheet" include not only paper used in common printing apparatus, but cloth, plastic films, metal plates, glass, ceramics, wood, leather or any other material that can receive ink. This word will be also referred to as "paper".

Further, the word "ink" (or "liquid") should be interpreted in its wide sense as with the word "print" and refers to liquid that is applied to the printing medium to form images, designs or patterns, process the printing medium or process ink (for example, coagulate or make insoluble a colorant in the ink applied to the printing medium).

1. Apparatus Body

Figure 1:
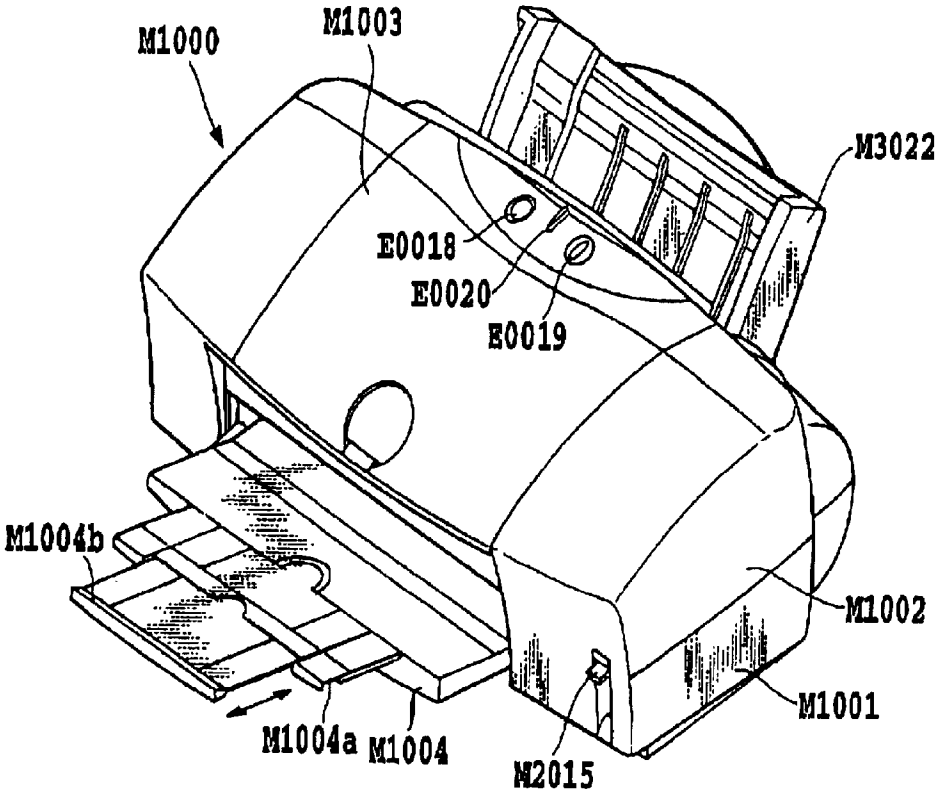
FIG. 1 is a perspective view showing an external construction of an ink jet printer as one embodiment of the present invention.
Figure 2:
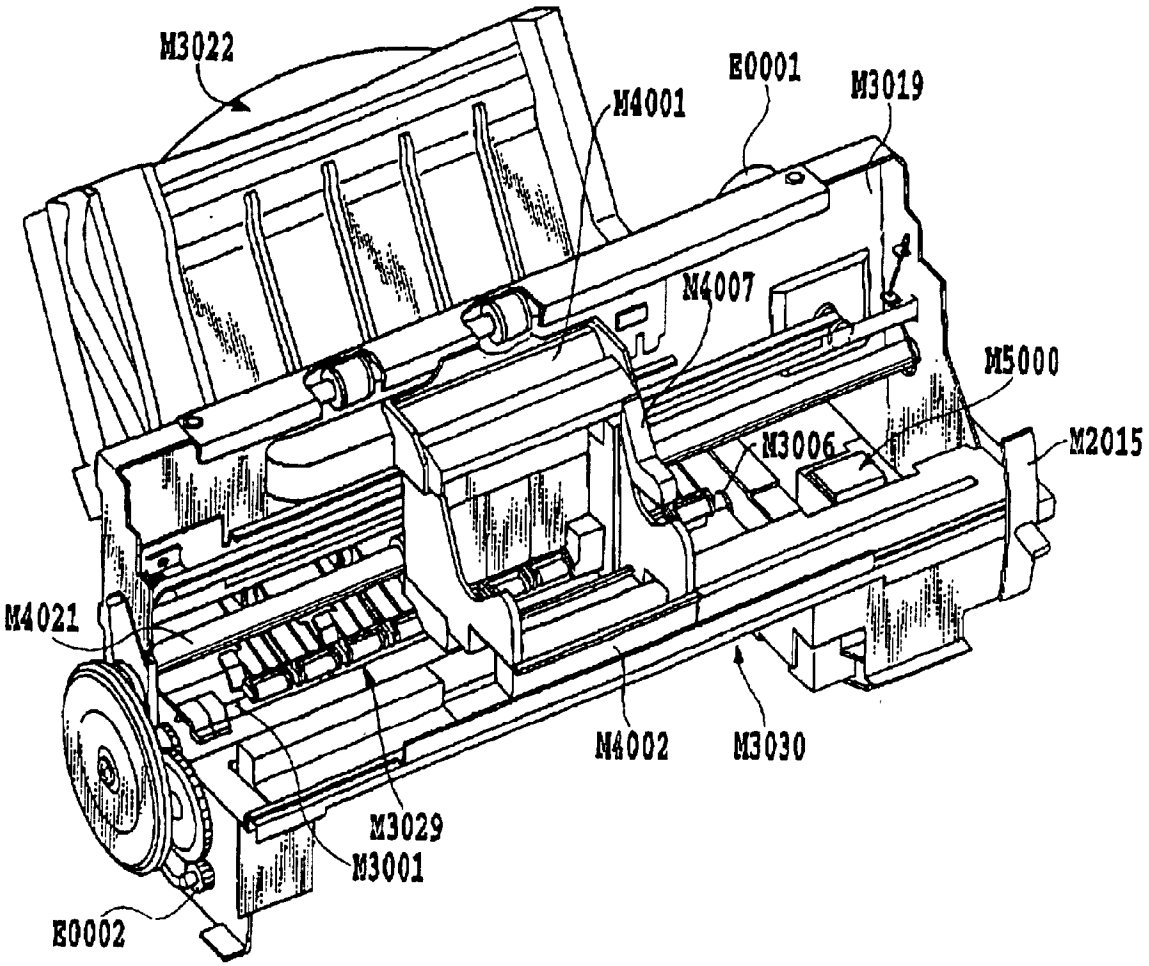
FIG. 2 is a perspective view showing the printer of FIG. 1 with an enclosure member removed.

FIGS. 1 and 2 show an outline construction of a printer using an ink jet printing system. In FIG. 1, a housing of a printer body M1000 of this embodiment has an enclosure member, including a lower case M1001, an upper case M1002, an access cover M1003 and a discharge tray M1004, and a chassis M3019 (see FIG. 2) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printer body M1000 and the upper case M1002 forms roughly an upper half of the printer body M1000. These upper and lower cases, when combined, form a hollow structure having an accommodation space therein to accommodate various mechanisms described later. The printer body M1000 has an opening in its top portion and front portion. thereof rotatably supported on the lower case M1001. The discharge tray M1004, when rotated, opens or closes an opening formed in the front portion of the lower case M1001. When the print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

At the upper rear surface of the upper case M1002 a power key E0018, a resume key E0019 and an LED E0020 are provided. When the power key E0018 is pressed, the LED E0020 lights up indicating to an operator that the apparatus is ready to print. The LED E0020 has a variety of display functions, such as alerting the operator to printer troubles as by changing its blinking intervals and color. Further, a buzzer E0021 (FIG. 7) may be sounded. When the trouble is eliminated, the resume key E0019 is pressed to resume the printing.

2. Printing Operation Mechanism

Next, a printing operation mechanism installed and held in the printer body M1000 according to this embodiment will be explained.

The printing operation mechanism in this embodiment comprises; an automatic sheet feed unit M3022 to automatically feed a print sheet into the printer body; a sheet transport unit M3029 to guide the print sheets, fed one at a time from the automatic sheet feed unit, to a predetermined print position and to guide the print sheet from the print position to a discharge unit M3030; a print unit to perform a desired printing on the print sheet carried to the print position; and an ejection performance recovery unit M5000 to recover the ink ejection performance of the print unit.

Here, the print unit will be described. The print unit comprises a carriage M4001 movably supported on a carriage shaft M4021 and a print head cartridge H1000 removably mounted on the carriage M4001.

2.1 Print Head Cartridge

First, the print head cartridge used in the print unit will be described with reference to FIGS. 3 to 5.

Figure 3:
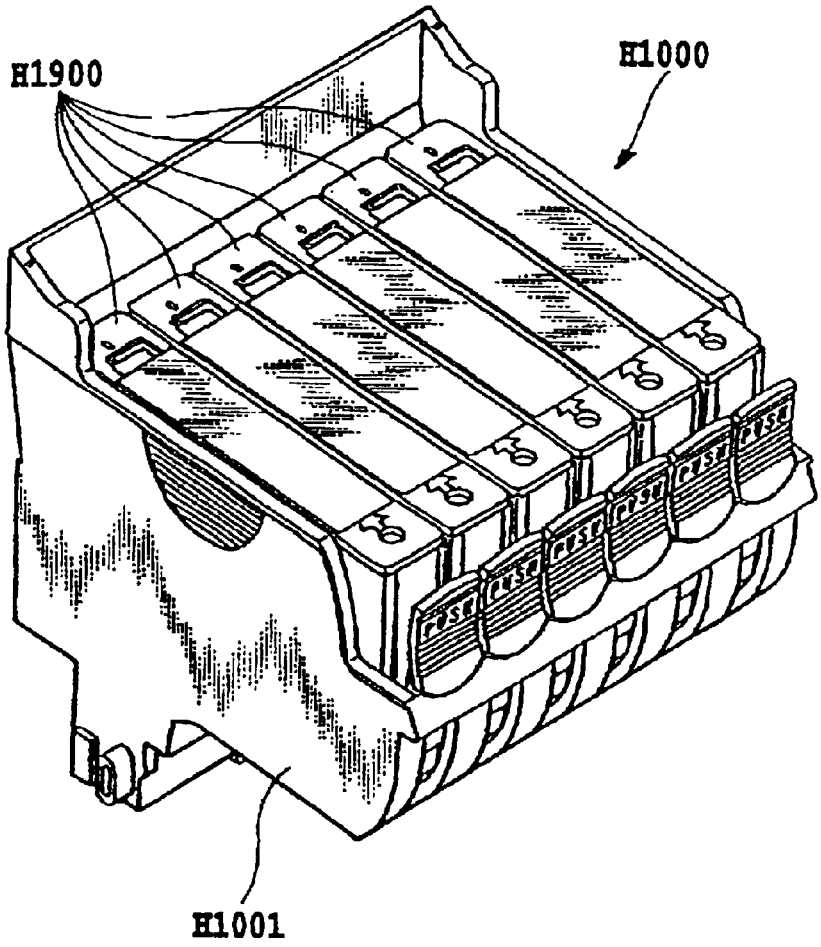
FIG. 3 is a perspective view showing an assembled print head cartridge used in a printer as one embodiment of the invention.
Figure 4:
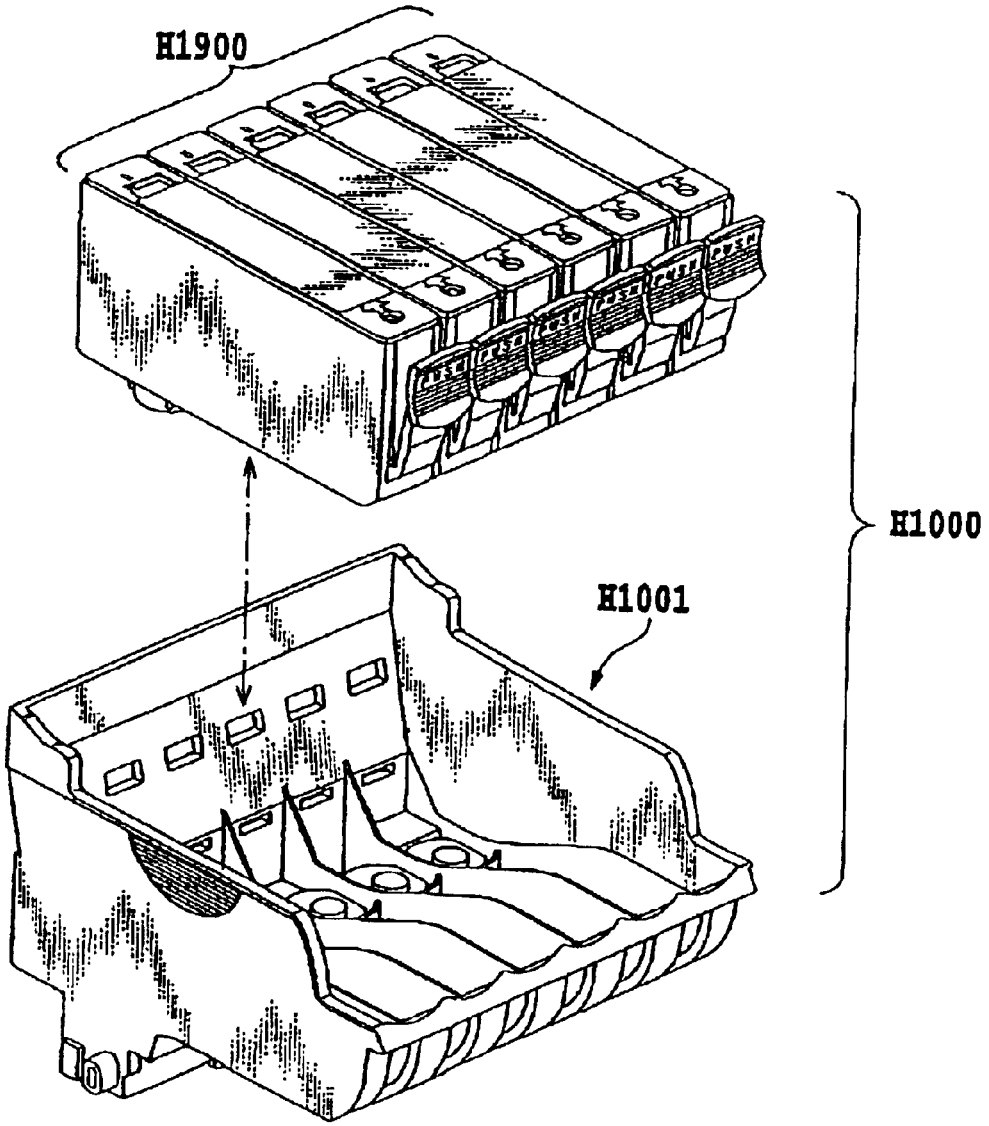
FIG. 4 is a perspective view showing the print head cartridge of FIG. 3 in a disassembled state.

The print head cartridge H1000 in this embodiment, as shown in FIG. 3, has an ink tank H1900 containing inks and a print head H1001 for ejecting ink supplied from the ink tank H1900 out through nozzles according to print information The print head H1001 is of a so-called cartridge type in which it is removably mounted to the carriage M4001 described later.

The ink tank for this print head cartridge H1000 consists of separate ink tanks H1900 of, for example, black, light cyan, light magenta, cyan, magenta and yellow to enable color printing with as high an image quality as photograph. As shown in FIG. 4, these individual ink tanks are removably mounted to the print head H1001.

Figure 5:
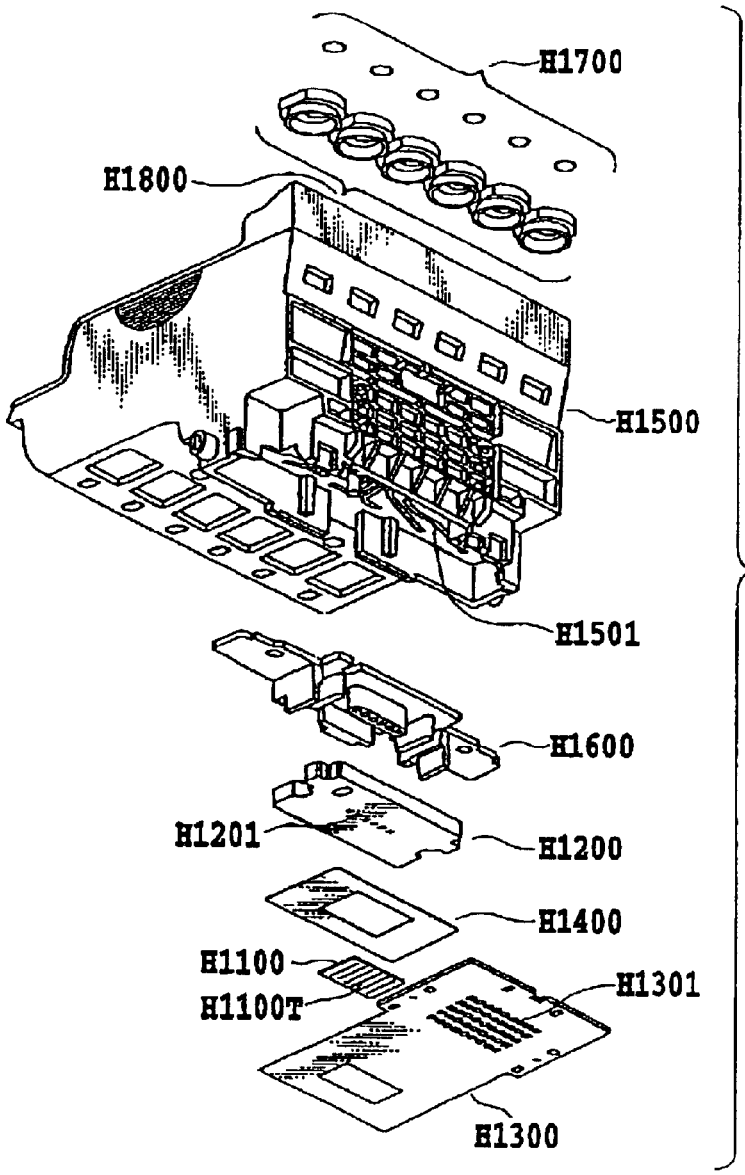
FIG. 5 is an exploded perspective view of the print head of FIG. 4 as seen from diagonally below.

Then, the print head H1001, as shown in the perspective view of FIG. 5, comprises a print element substrate H1100, a first plate H1200, an electric wiring board H1300, a second plate H1400, a tank holder H1500, a flow passage forming member H1600, a filter H1700 and a seal rubber H1800.

The print element silicon substrate H1100 has formed in one of its surfaces, by the film deposition technology, a plurality of print elements to produce energy for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages. The print element substrate H1100 is securely bonded to the first plate H1200 which is formed with ink supply ports H1201 for supplying ink to the print element substrate H1100. The first plate H1200 is securely bonded with the second plate H1400 having an opening. The second plate H1400 holds the electric wiring board H1300 to electrically connect the electric wiring board H1300 with the print element substrate H1100. The electric wiring board H1300 is to apply electric signals for ejecting ink to the print element substrate H1100, and has electric wires associated with the print element substrate H1100 and external signal input terminals H1301 situated at electric wires ends for receiving electric signals from the printer body. The external signal input terminals H1301 are positioned and fixed at the back of a tank holder H1500 described later.

The tank holder H1500 that removably holds the ink tank H1900 is securely attached, as by ultrasonic fusing, with the flow passage forming member H1600 to form an ink passage H1501 from the ink tank H1900 to the first plate H1200. At the ink tank side end of the ink passage H1501 that engages with the ink tank H1900, a filter H1700 is provided to prevent external dust from entering. A seal rubber H1800 is provided at a portion where the filter H1700 engages the ink tank H1900, to prevent evaporation of the ink from the engagement portion.

As described above, the tank holder unit, which includes the tank holder H1500, the flow passage forming member H1600, the filter H1700 and the seal rubber H1800, and the print element unit, which includes the print element substrate 1100, the first plate H1200, the electric wiring board H1300 and the second plate H1400, are combined as by adhesives to form the print head H1001.

2.2 Carriage

Next, by referring to FIG. 2, the carriage M4001 carrying the print head cartridge H1000 will be explained.

As shown in FIG. 2, the carriage M4001 has a carriage cover M4002 for guiding the print head H1001 to a predetermined mounting position on the carriage M4001, and a head set lever M4007 that engages and presses against the tank holder H1500 of the print head H1001 to set the print head H1001 at a predetermined mounting position.

That is, the head set lever M4007 is provided at the upper part of the carriage M4001 so as to be pivotable about a head set lever shaft. There is a spring-loaded head set plate (not shown) at an engagement portion where the carriage M4001 engages the print head H1001. With the spring force, the head set lever M4007 presses against the print head H1001 to mount it on the carriage M4001.

At another engagement portion of the carriage M4001 with the print head H1001, there is provided a contact flexible printed cable (see FIG. 7: simply referred to as a contact FPC hereinafter) E0011 whose contact portion electrically contacts a contact portion (external signal input terminals) H1301 provided in the print head H1001 to transfer various information for printing and supply electricity to the print head H1001.

Between the contract portion of the contact FPC E0011 and the carriage M4001 there is an elastic member not shown, such as rubber. The elastic force of the elastic member and the pressing force of the head set lever spring combine to ensure a reliable contact between the contact portion of the contact FPC E0011 and the carriage M4001. Further, the contact FPC E0011 is connected to a carriage substrate E0013 mounted at the back of the carriage M4001 (see FIG. 7).

3. Scanner

The printer of this embodiment can mount a scanner in the carriage M4001 in place of the print head cartridge H1000 and be used as a reading device.

The scanner moves together with the carriage M4001 in the main scan direction, and reads an image on a document fed instead of the printing medium as the scanner moves in the main scan direction. Alternating the scanner reading operation in the main scan direction and the document feed in the sub-scan direction enables one page of document image information to be read.

Figures 6A, 6B:
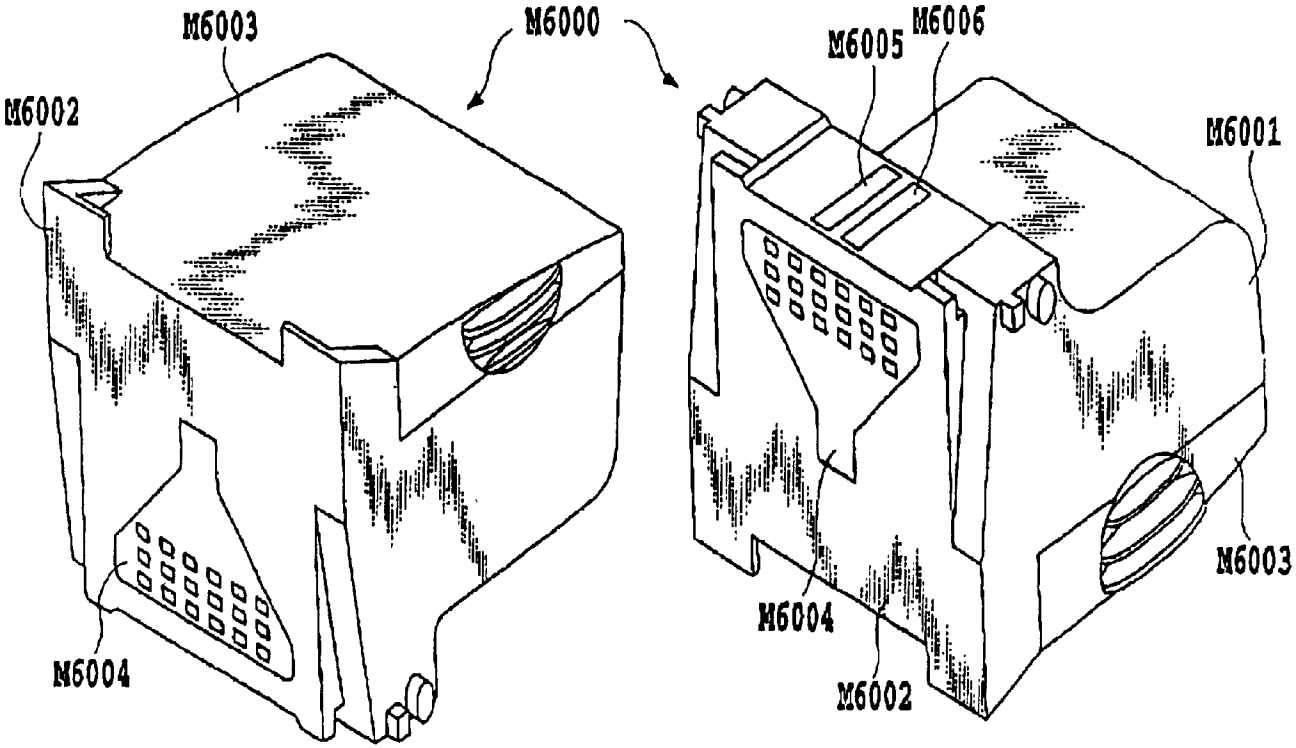
FIG. 6A is a perspective view showing an upper side of a scanner cartridge that can be mounted in a printer as one embodiment of the invention in place of the print head cartridge of FIG. 3.
FIG. 6B is a perspective view showing a lower side of a scanner cartridge that can be mounted in a printer as one embodiment of the invention in place of the print head cartridge of FIG. 3.

FIGS. 6A and 6B show the scanner M6000 upside down to explain about its outline construction.

As shown in the figure, a scanner holder M6001 is shaped like a box and contains an optical system and a processing circuit necessary for reading. A reading lens M6006 is provided at a portion that faces the surface of a document when the scanner M6000 is mounted on the carriage M4001. The lens M6006 focuses light reflected from the document surface onto a reading unit inside the scanner to read the document image. An illumination lens M6005 has a light source not shown inside the scanner. The light emitted from the light source is radiated onto the document through the lens M6005.

The scanner cover M6003 secured to the bottom of the scanner holder M6001 shields the interior of the scanner holder M6001 from light Louver-like grip portions are provided at the sides to improve the ease with which the scanner can be mounted to and dismounted from the carriage M4001. The external shape of the scanner holder M6001 is almost similar to that of the print head H1001, and the scanner can be mounted to or dismounted from the carriage M4001 in a manner similar to that of the print head H1001.

The scanner holder M6001 accommodates a substrate having a reading circuit, and a scanner contact PCB M6004 connected to this substrate is exposed outside. When the scanner M6000 is mounted on the carriage M4001, the scanner contact PCB M6004 contacts the contact FPC E0011 of the carriage M4001 to electrically connect the substrate to a control system on the printer body side through the carriage M4001.

4. Example Configuration of Printer Electric Circuit

Next, an electric circuit configuration in this embodiment of the invention will be explained.

Figure 7:
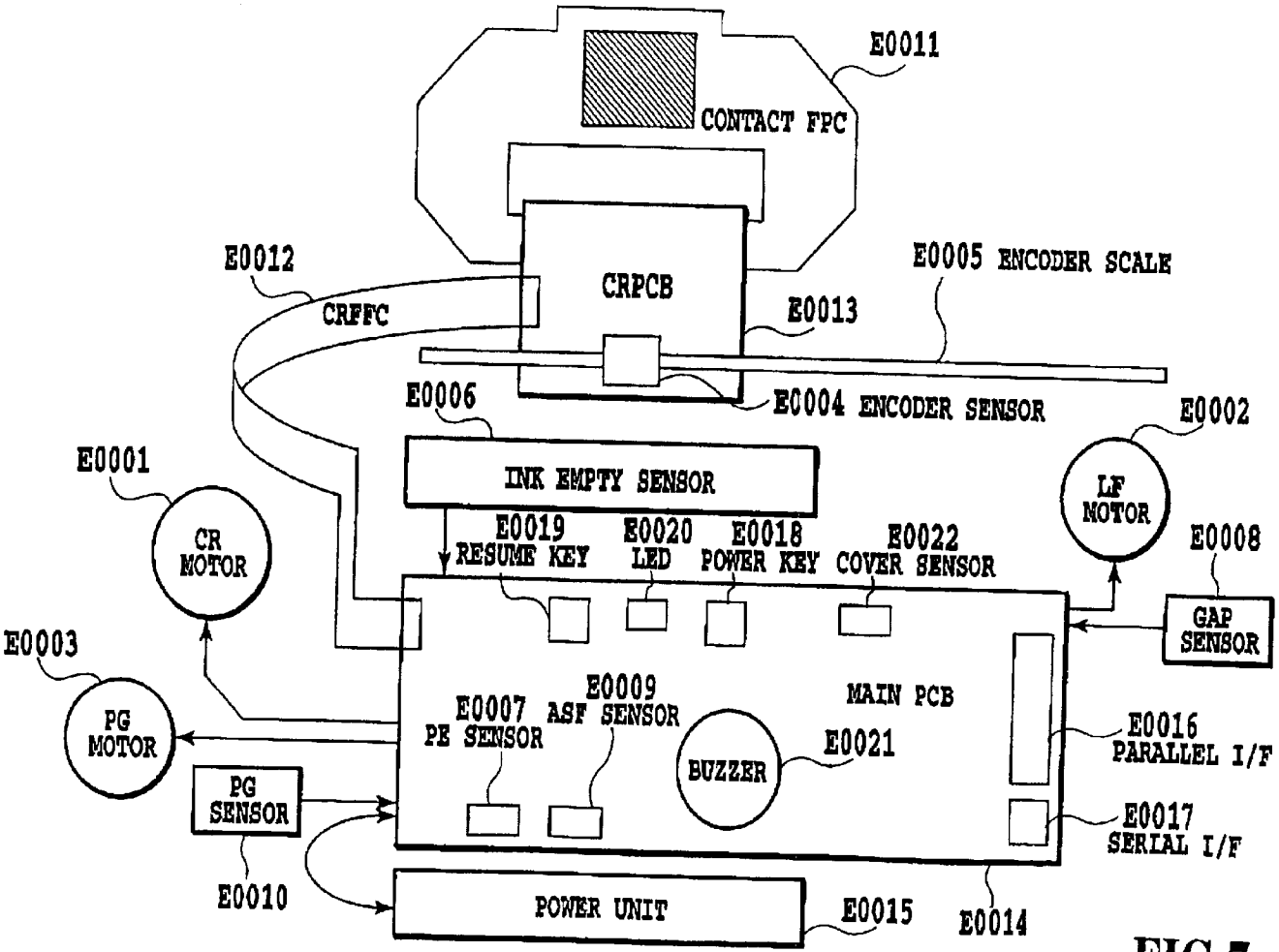
FIG. 7 is a block diagram schematically showing an overall configuration of an electric circuit in a printer as one embodiment of the invention.

FIG. 7 schematically shows the overall configuration of the electric circuit in this embodiment.

The electric circuit in this embodiment comprises mainly a carriage substrate (CRPCB) E0013, a main PCB (printed circuit board) E0014 and a power supply unit E0015.

The power supply unit E0015 is connected to the main PCB E0014 to supply a variety of drive power.

The carriage substrate E0013 is a printed circuit board unit mounted on the carriage M4001 (FIG. 2) and functions as an interface for transferring signals to and from the print head through the contact FPC E0011. In addition, based on a pulse signal output from an encoder sensor E0004 as the carriage M4001 moves, the carriage substrate E0013 detects a change in the positional relation between an encoder scale E0005 and the encoder sensor E0004 and sends its output signal to the main PCB E0014 through a flexible flat cable (CRFFC) E0012.

Further, the main PCB E0014 is a printed circuit board unit that controls the operation of various parts of the ink jet printing apparatus in this embodiment, and has I/O ports for a paper end sensor (PE sensor) E0007, an automatic sheet feeder (ASF) sensor E0009, a cover sensor E0022, a parallel interface (parallel I/F) E0016, a serial interface (Serial I/F) E0017, a resume key E0019, an LED E0020, a power key E0018 and a buzzer E0021. The main PCB E0014 is connected to and controls a motor (CR motor) E0001 that constitutes a drive source for moving the carriage M4001 in the main scan direction; a motor (LF motor) E0002 that constitutes a drive source for transporting the printing medium; and a motor (PG motor) E0003 that performs the functions of recovering the ejection performance of the print head and feeding the printing medium. The main PCB E0014 also has connection interfaces with an ink empty sensor E0006, a gap sensor E0008, a PG sensor E0010, the CRFFC E0012 and the power supply unit E0015.

Figures 8, 8A:
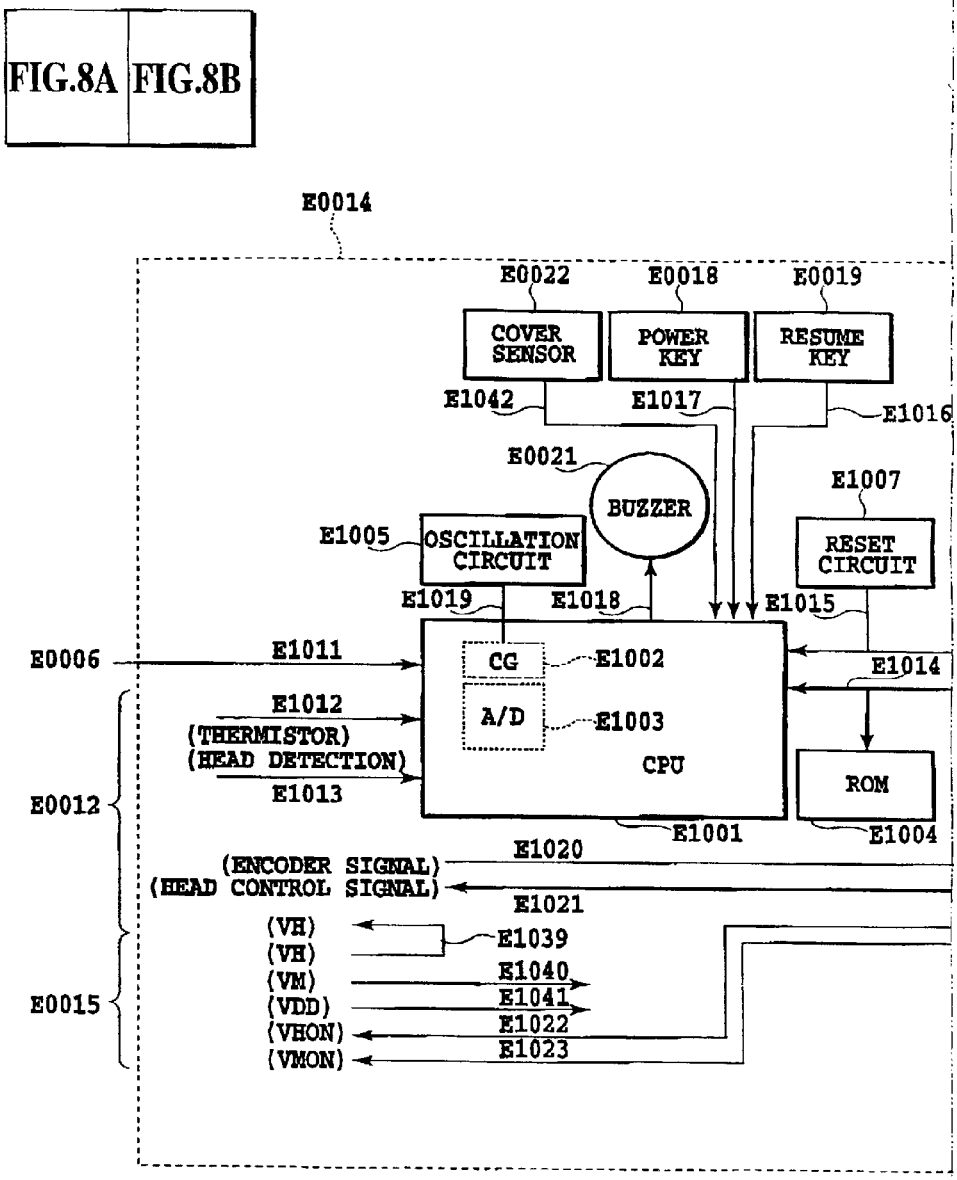
FIG. 8 is a diagram showing the relationship between FIGS. 8A and 8B.
FIGS. 8A and 8B are block diagrams showing an example internal configuration of a main printed circuit board (PCB) in the electric circuit of FIG. 7.
Figure 8B:
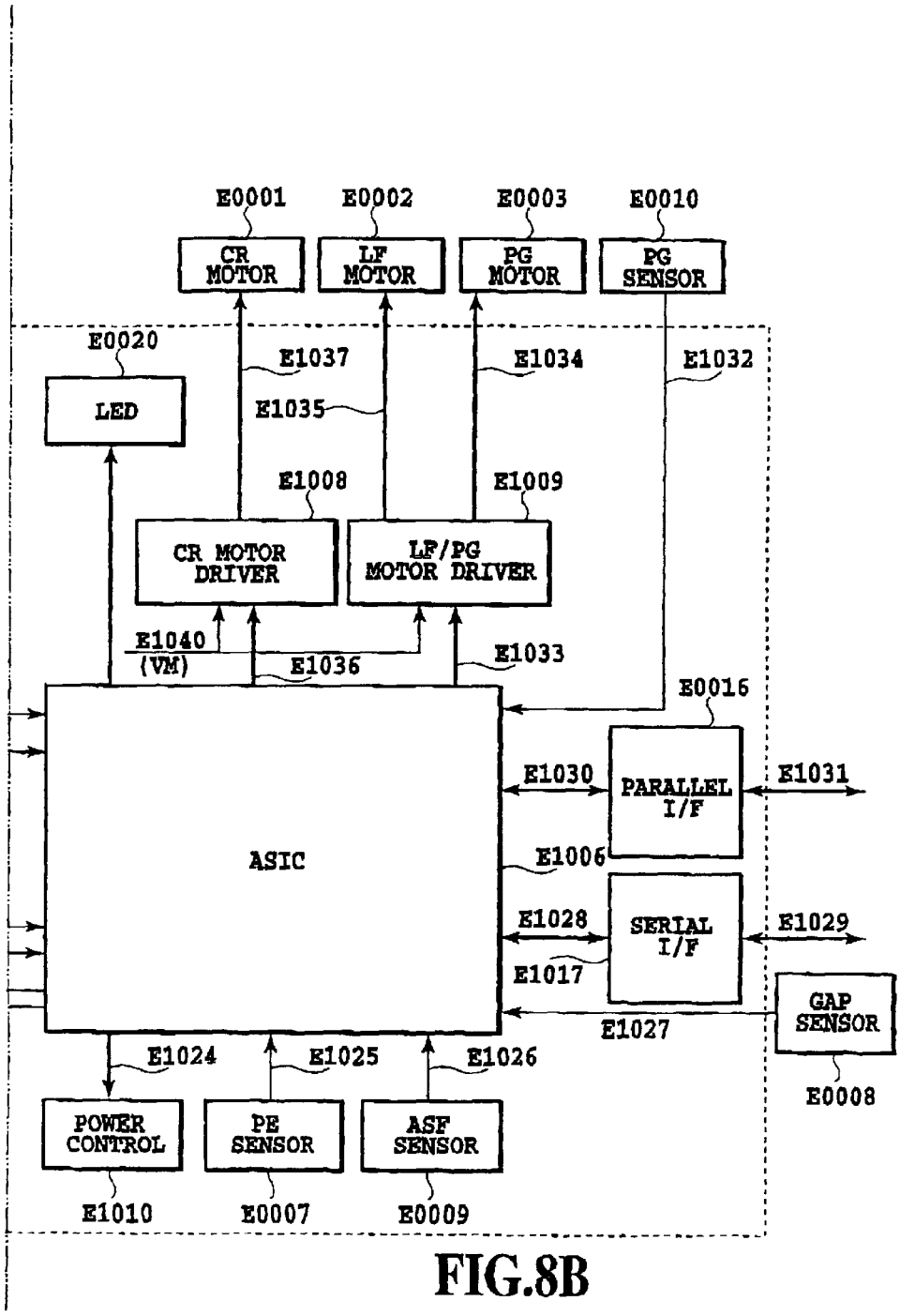

FIG. 8 is a diagram showing the relation between FIGS. 8A and 8B, and FIGS. 8A and 8B are block diagrams showing an inner configuration of the main PCB E0014.

Reference number E1001 represents a CPU, which has a clock generator (CG) E1002 connected to an oscillation circuit E1005 to generate a system clock based on an output signal E1019 of the oscillation circuit E1005. The CPU E1001 is connected to an ASIC (application specific integrated circuit) and a ROM E1004 through a control bus E1014. According to a program stored in the ROM E1004, the CPU E1001 controls the ASIC E1006, checks the status of an input signal E1017 from the power key, an input signal E1016 from the resume key, a cover detection signal E1042 and a head detection signal (HSENS) E1013, drives the buzzer E0021 according to a buzzer signal (BUZ) E101B, and checks the status of an ink empty detection signal (INKS) E1011 connected to a built-in A/D converter E1003 and of a temperature detection signal (TH) E1012 from a thermistor. The CPU E1001 also performs various other logic operations and makes conditional decisions to control the operation of the ink jet printing apparatus.

The head detection signal E1013 is a head mount detection signal entered from the print head cartridge H1000 through the flexible flat cable E0012, the carriage substrate E0013 and the contact FPC E0011. The ink empty detection signal E1011 is an analog signal output from the ink empty sensor E0006. The temperature detection signal E1012 is an analog signal from the thermistor (not shown) provided on the carriage substrate E0013.

Designated E1008 is a CR motor driver that uses a motor power supply (VM) E1040 to generate a CR motor drive signal E1037 according to a CR motor control signal E1036 from the ASIC B1006 to drive the CR motor E0001. E1009 designates an LF/PG motor driver which uses the motor power supply E1040 to generate an LF motor drive signal E1035 according to a pulse motor control signal (PM control signal) E1033 from the ASIC E1006 to drive the LF motor. The LF/PG motor driver E1009 also generates a PG motor drive signal E1034 to drive the PG motor.

Designated E1010 is a power supply control circuit which controls the supply of electricity to respective sensors with light emitting elements according to a power supply control signal E1024 from the ASIC E1006. The parallel I/F E0016 transfers a parallel I/F signal E1030 from the ASIC E1006 to a parallel I/F cable E1031 connected to external circuits and also transfers a signal of the parallel I/F cable E1031 to the ASIC E1006. The serial I/F E0017 transfers a serial I/F signal E1028 from the ASIC E1006 to a serial I/F cable E1029 connected to external circuits, and also transfers a signal from the serial I/F cable E1029 to the ASIC E1006.

The power supply unit E0015 provides a head power signal (VH) E1039, a motor power signal (VM) E1040 and a logic power signal (VDD) E1041. A head power ON signal (VHON) E1022 and a motor power ON signal (VMON) E1023 are sent from the ASIC E1006 to the power supply unit E0015 to perform the ON/OFF control of the head power signal E1039 and the motor power signal E1040. The logic power signal (VDD) E1041 supplied from the power supply unit E0015 is voltage-converted as required and given to various parts inside or outside the main PCB E0014.

The head power signal E1039 is smoothed by a circuit of the main PCB E0014 and then sent out to the flexible flat cable E0011 to be used for driving the print head cartridge H1000.

E1007 denotes a reset circuit which detects a reduction in the logic power signal E1041 and sends a reset signal (RESET) to the CPU E1001 and the ASIC E1006 to initialize them.

The ASIC E1006 is a single-chip semiconductor integrated circuit and is controlled by the CPU E1001 through the control bus E1014 to output the CR motor control signal E1036, the PM control signal E1033, the power supply control signal E1024, the head power ON signal E1022 and the motor power ON signal E1023. It also transfers signals to and from the parallel interface E0016 and the serial interface E0017. In addition, the ASIC E1006 detects the status of a PE detection signal (PES) E1025 from the PE sensor E0007, an ASF detection signal (ASFS) E1026 from the ASF sensor E0009, a gap detection signal (GAPS) E1027 from the GAP sensor E0008 for detecting a gap between the print head and the printing medium, and a PG detection signal (PGS) E1032 from the PG sensor E0010, and sends data representing the statuses of these signals to the CPU E1001 through the control bus E1014. Based on the data received, the CPU E1001 controls the operation of an LED drive signal E1038 to turn on or off the LED E0020.

Further, the ASIC E1006 checks the status of an encoder signal (ENC) E1020, generates a timing signal, interfaces with the print head cartridge H1000 and controls the print operation by a head control signal E1021. The encoder signal (ENC) E1020 is an output signal of the CR encoder sensor E0004 received through the flexible flat cable E0012. The head control signal E1021 is sent to the print head H1001 through the flexible flat cable E0012, carriage substrate E0013 and contact FPC E0011.

Figures 9, 9A:
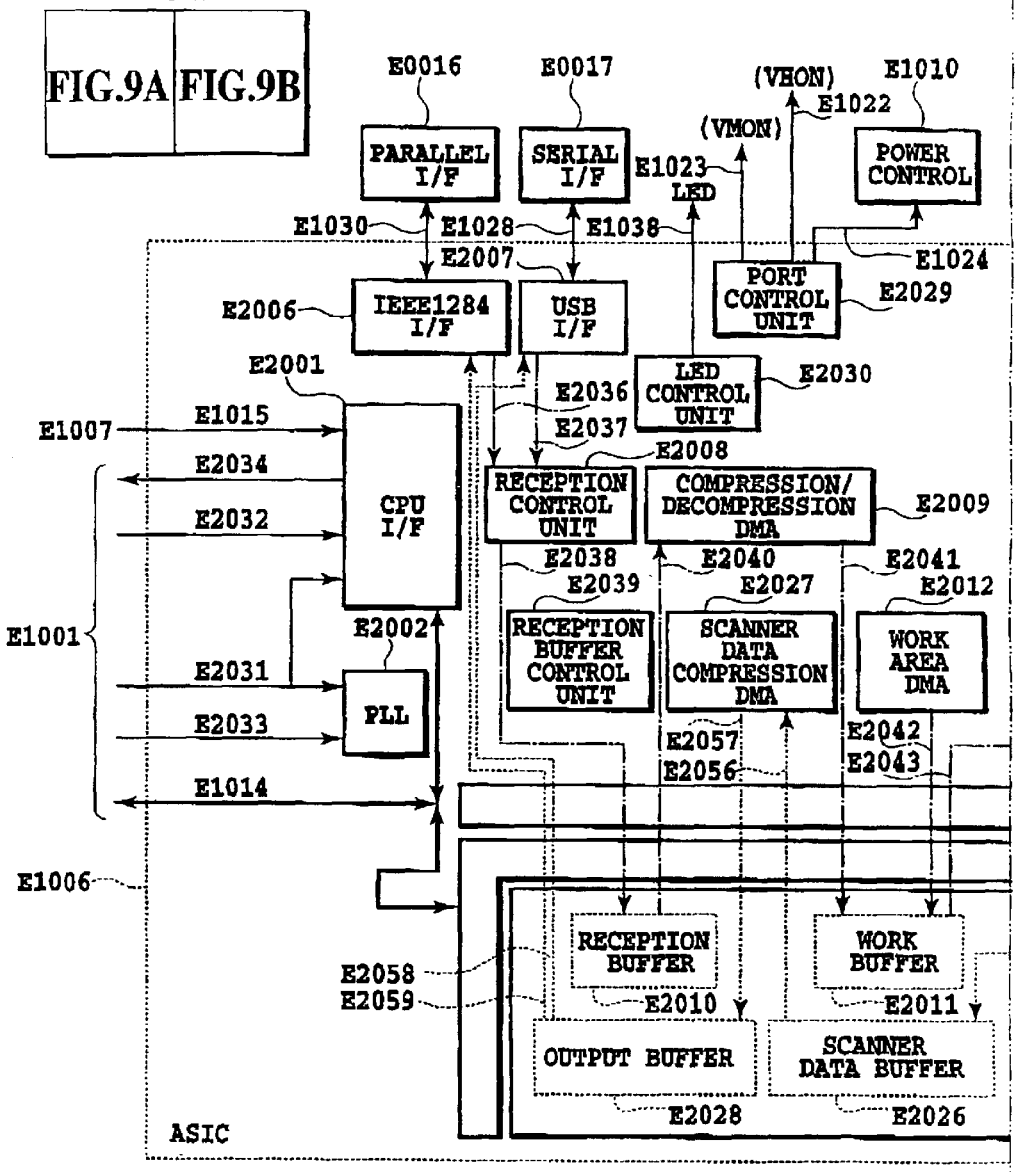
FIG. 9 is a diagram showing the relationship between FIGS. 9A and 9B.
FIGS. 9A and 9B are block diagrams showing an example internal configuration of an ASIC in the main PCB of FIGS. 8A and 8B.
Figure 9B:
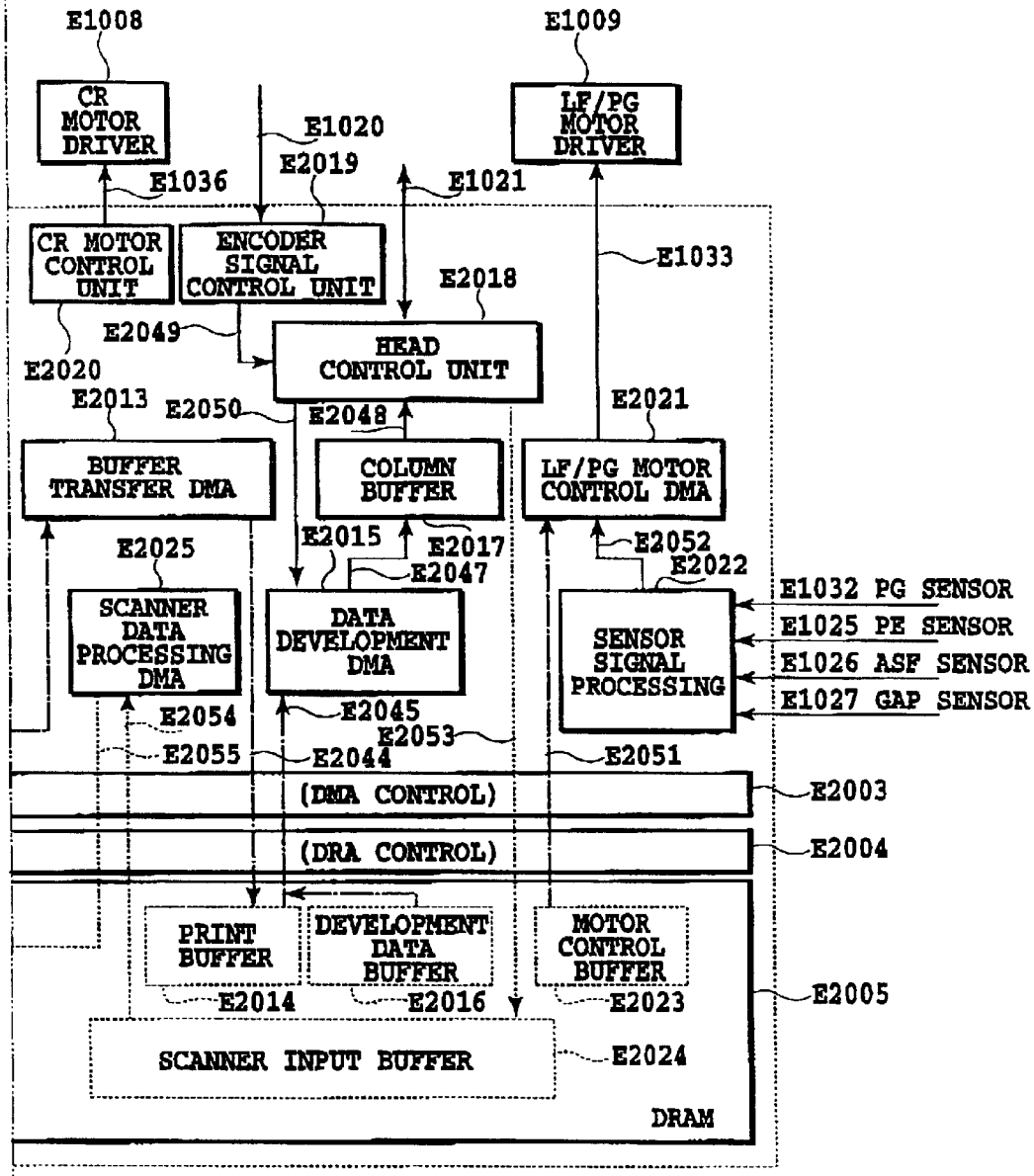

FIG. 9 is a diagram showing the relation between FIGS. 9A and 9B, and FIGS. 9A and 9B are block diagrams showing an example internal configuration of the ASIC E1006.

In these figures, only the flow of data, such as print data and motor control data, associated with the control of the head and various mechanical components is shown between each block, and control signals and clocks associated with the read/write operation of the registers incorporated in each block and control signals associated with the DMA control are omitted to simplify the drawings.

In the figures, reference number E2002 represents a PLL controller which, based on a clock signal (CLK) E2031 and a PLL control signal (PLLON) E2033 output from the CPU E1001, generates a clock (not shown) to be supplied to the most part of the ASIC E1006.

Denoted E2001 is a CPU interface (CPU I/F) E2001, which controls the read/write operation of register in each block, supplies a clock to some blocks and accepts an interrupt signal (none of these operations are shown) according to a reset signal E1015, a software reset signal (PDWN) B2032 and a clock signal (CLK) E2031 output from the CPU E1001, and control signals from the control bus E1014. The CPU I/F E2001 then outputs an interrupt signal (INT) E2034 to the CPU E1001 to inform it of the occurrence of an interrupt within the ASIC E1006.

E2005 denotes a DRAM which has various areas for storing print data, Such as a reception buffer E2010, a work buffer E2011, a print buffer E2014 and a development data buffer E2016. The DRAM E2005 also has a motor control buffer E2023 for motor control and, as buffers used instead of the above print data buffers during the scanner operation mode, a scanner input buffer E2024, a scanner data buffer E2026 and an output buffer E2028.

The DRAM E2005 is also used as a work area by the CPU E1001 for its own operation. Designated E2004 is a DRAM control unit E2004 which performs read/write operations on the DRAM E2005 by switching between the DRAM access from the CPU E1001 through the control bus and the DRAM access from a DMA control unit E2003 described later.

The DMA control unit E2003 accepts request signals (not shown) from various blocks and outputs address signals and control signals (not shown) and, in the case of write operation, write data B2038, E2041, E2044, E2053, E2055, E2057 etc. to the DRAM control unit to make DRAM accesses. In the case of read operation, the DMA control unit E2003 transfers the read data E2040, E2043, E2045. E2051, E2054, E2056, E2058, E2059 from the DRAM control unit E2004 to the requesting blocks.

Denoted E2006 is an IEEE 1284 I/F which functions as a bi-directional communication interface with external host devices, not shown, through the parallel I/F E0016 and is controlled by the CPU E1001 via CPU I/F E2001. During the printing operation, the IEEE 1284 I/F E2006 transfers the receive data (PIF receive data E2036) from the parallel I/F E0016 to a reception control unit E2008 by the DMA processing. During the scanner reading operation, the 1284 I/F E2006 sends the data (1284 transmit data (RDPIF) E2059) stored in the output buffer E2028 in the DRAM E2005 to the parallel I/F E0016 by the DMA processing.

Designated E2007 is a universal serial bus (USB) I/F which offers a bi-directional communication interface with external host devices, not shown, through the serial I/F E0017 and is controlled by the CPU E1001 through the CPU I/F E2001. During the printing operation, the universal serial bus (USB) I/F E2007 transfers received data (USB receive data E2037) from the serial I/F E0017 to the reception control unit E2008 by the DMA processing. During the scanner reading, the universal serial bus (USB) I/F E2007 sends data (USB transmit data (RDUSB) E2058) stored in the output buffer E2028 in the DRAM E2005 to the serial I/F E0017 by the DMA processing. The reception control unit E2008 writes data (WDIF E2038) received from the 1284 I/F E2006 or universal serial bus (USB) I/F E2007, whichever is selected, into a reception buffer write address managed by a reception buffer control unit E2039.

Designated E2009 is a compression/decompression DMA controller which is controlled by the CPU E1001 through the CPU I/F E2001 to read received data (raster data) stored in a reception buffer E2010 from a reception buffer read address managed by the reception buffer control unit E2039, compress or decompress the data (RDWK) E2040 according to a specified mode, and write the data as a print code string (WDWK) E2041 into the work buffer area.

Designated E2013 is a print buffer transfer DMA controller which is controlled by the CPU E1001 through the CPU I/F E2001 to read print codes (RDWP) E2043 on the work buffer E2011 and rearrange the print codes onto addresses on the print buffer E2014 that match the sequence of data transfer to the print head cartridge H1000 before transferring the codes (WDWP E2044). Reference number E2012 denotes a work area DMA controller which is controlled by the CPU E1001 through the CPU I/F E2001 to repetitively write specified work fill data (WDWF) E2042 into the area of the work buffer whose data transfer by the print buffer transfer DMA controller E2013 has been completed.

Designated E2015 is a print data development DMA controller E2015, which is controlled by the CPU E1001 through the CPU I/F E2001. Triggered by a data development timing signal E2050 from a head control unit E2018, the print data development DMA controller E2015 reads the print code that was rearranged and written into the print buffer and the development data written into the development data buffer E2016 and writes developed print data (RDHDG) E2045 into the column buffer E2017 as column buffer write data (WDHDG) E2047. The column buffer E2017 is an SRAM that temporarily stores the transfer data (developed print data) to be sent to the print head cartridge H1000, and is shared and managed by both the print data development DMA CONTROLLER and the head control unit through a handshake signal (not shown).

Designated E2018 is a head control unit E2018 which is controlled by the CPU E1001 through the CPU I/F E2001 to interface with the print head cartridge H1000 or the scanner through the head control signal. It also outputs a data development timing signal E2050 to the print data development DMA controller according to a head drive timing signal E2049 from the encoder signal processing unit E2019.

During the printing operation, the head control unit E2018, when it receives the head drive timing signal E2049, reads developed print data (RDHD) E2048 from the column buffer and outputs the data to the print head cartridge H1000 as the head control signal E1021.

In the scanner reading mode, the head control unit B2018 DMA-transfers the input data (WDHD) E2053 received as the head control signal E1021 to the scanner input buffer E2024 on the DRAM E2005. Designated B2025 is a scanner data processing DMA controller E2025 which is controlled by the CPU E1001 through the CPU I/F E2001 to read input buffer read data (RDAV) E2054 stored in the scanner input buffer E2024 and writes the averaged data (WDAV) E2055 into the scanner data buffer E2026 on the DRAM E2005.

Designated E2027 is a scanner data compression DMA controller which is controlled by the CPU E1001 through the CPU I/F E2001 to read processed data (RDYC) E2056 on the scanner data buffer E2026, perform data compression, and write the compressed data (WDYC) E2057 into the output buffer E2028 for transfer.

Designated E2019 is an encoder signal processing unit which, when it receives an encoder signal (ENC), outputs the head drive timing signal E2049 according to a mode determined by the CPU E1001. The encoder signal processing unit E2019 also stores in a register information on the position and speed of the carriage M4001 obtained from the encoder signal E1020 and presents it to the CPU E1001. Based on this information, the CPU E1001 determines various parameters for the CR motor E0001. Designated E2020 is a CR motor control unit which is controlled by the CPU E1001 through the CPU I/F E2001 to output the CR motor control signal E1036.

Denoted E2022 is a sensor signal processing unit which receives detection signals E1032, E1025, E1026 and E1027 output from the PG sensor E0010, the PE sensor E0007, the ASF sensor E0009 and the gap sensor E0008, respectively, and transfers these sensor information to the CPU E1001 according to the mode determined by the CPU E1001. The sensor signal processing unit E2022 also outputs a sensor detection signal E2052 to a DMA controller E2021 for controlling LF/PG motor.

The DMA controller E2021 for controlling LF/PG motor is controlled by the CPU E1001 through the CPU I/F E2001 to read a pulse motor drive table (RDPM) E2051 from the motor control buffer E2023 on the DRAM E2005 and output a pulse motor control signal E1033. Depending on the operation mode, the controller outputs the pulse motor control signal E1033 upon reception of the sensor detection signal as a control trigger.

Designated E2030 is an LED control unit which is controlled by the CPU E1001 through the CPU I/F E2001 to output an LED drive signal E1038. Further, designated E2029 is a port control unit which is controlled by the CPU E1001 through the CPU I/F E2001 to output the head power ON signal E1022, the motor power ON signal E1023 and the power supply control signal E1024.

5. Operation of Printer

Figure 10:
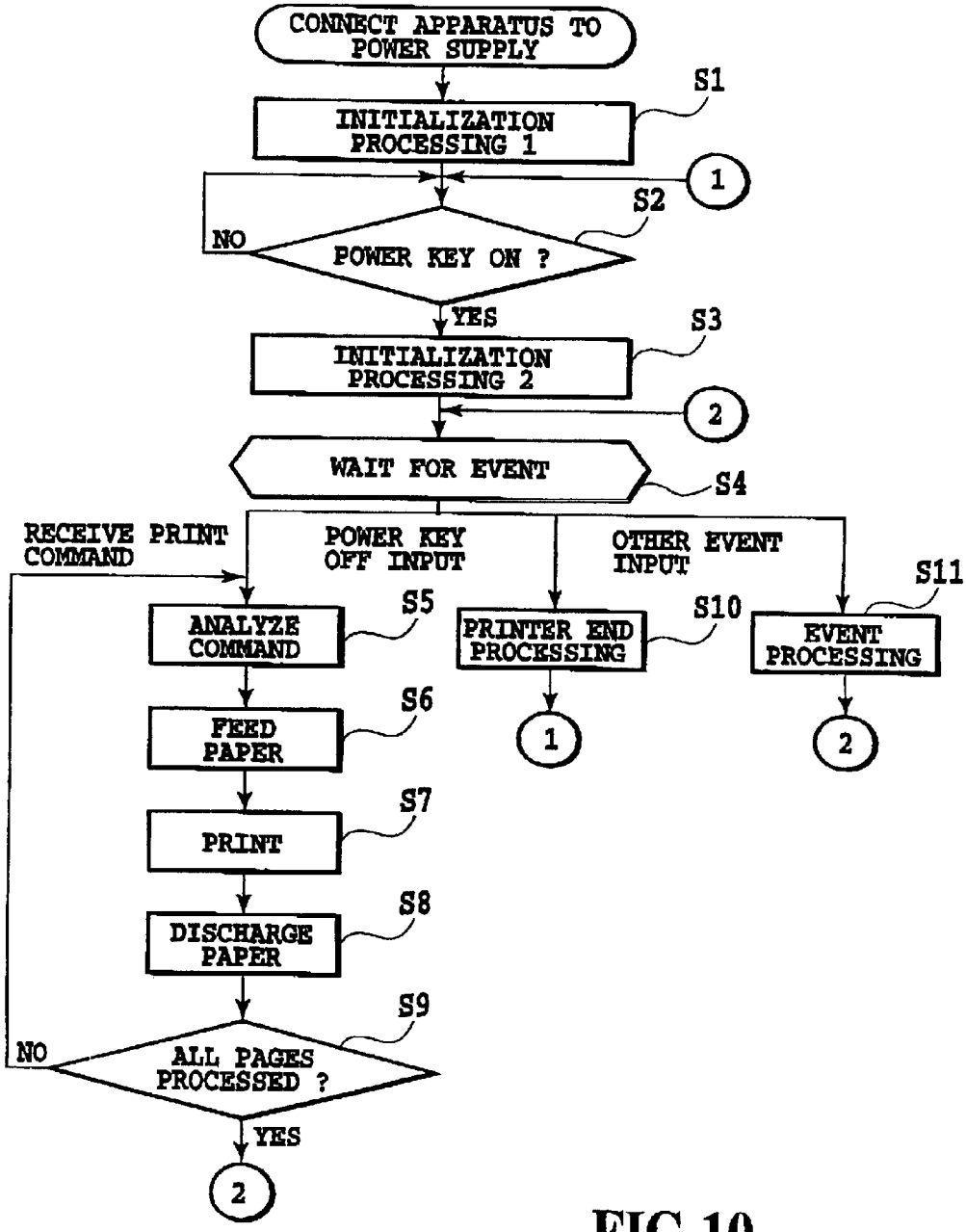
FIG. 10 is a flow chart showing an example sequence of basic operations of a printer as one embodiment of the invention.

Next, the operation of the ink jet printing apparatus in this embodiment of the invention with the above configuration will be explained by referring to the flow chart of FIG. 10.

When the printer body M1000 is connected to an AC power supply, a first initialization is performed at step S1. In this initialization process, the electric circuit system including the ROM and RAM in the apparatus is checked to confirm that the apparatus is electrically operable.

Next, step S2 checks if the power key E0018 on the upper case M1002 of the printer body M1000 is turned on. When it is decided that the power key E0018 is pressed, the processing moves to the next step S3 where a second initialization is performed.

In this second initialization, a check is made of various drive mechanisms and the print head of this apparatus. That is, when various motors are initialized and head information is read, it is checked whether the apparatus is normally operable.

Next, steps S4 waits for an event. That is, this step monitors a demand event from the external I/F, a panel key event from the user operation and an internal control event and, when any of these events occurs, executes the corresponding processing.

When, for example, step S4 receives a print command event from the external I/F, the processing moves to step S5. When a power key event from the user operation occurs at step S4, the processing moves to step S10. If another event occurs, the processing moves to step S11.

Step S5 analyzes the print command from the external I/F, checks a specified paper kind, paper size, print quality, paper feeding method and others, and stores data representing the check result into the DRAM E2005 of the apparatus before proceeding to step S6.

Next, step S6 starts feeding the paper according to the paper feeding method specified by the step S5 until the paper is situated at the print start position. The processing moves to step S7.

At step S7 the printing operation is performed. In this printing operation, the print data sent from the external I/F is stored temporarily in the print buffer. Then, the CR motor E0001 is started to move the carriage M4001 in the main-scanning direction. At the same time, the print data stored in the print buffer E2014 is transferred to the print head H1001 to print one line. When one line of the print data has been printed, the LF motor E0002 is driven to rotate the LF roller M3001 to transport the paper in the sub-scanning direction. After this, the above operation is executed repetitively until one page of the print data from the external I/F is completely printed, at which time the processing moves to step S8.

At step S8, the LF motor E0002 is driven to rotate the paper discharge roller M2003 to feed the paper until it is decided that the paper is completely fed out of the apparatus, at which time the paper is completely discharged onto the paper discharge tray M1004.

Next at step S9, it is checked whether all the pages that need to be printed have been printed and if there are pages that remain to be printed, the processing returns to step S5 and the steps S5 to S9 are repeated. When all the pages that need to be printed have been printed, the print operation is ended and the processing moves to step S4 waiting for the next event.

Step S10 performs the printing termination processing to stop the operation of the apparatus. That is, to turn off various motors and print head, this step renders the apparatus ready to be cut off from power supply and then turns off power, before moving to step S4 waiting for the next event.

Step S11 performs other event processing. For example, this step performs processing corresponding to the ejection performance recovery command from various panel keys or external I/F and the ejection performance recovery event that occurs internally. After the recovery processing is finished, the printer operation moves to step S4 waiting for the next event.

An example configuration in which the present invention can be used effectively is one that uses thermal energy generated by electrothermal transducers to cause a film boiling in liquid and thereby form bubbles.

(Characteristic Construction)

Next, a characteristic construction of the embodiment of this invention will be described with reference to the drawings. An ink jet printing apparatus in this embodiment has a basic construction already shown in FIG. 1 to FIG. 10.

Figure 11A:
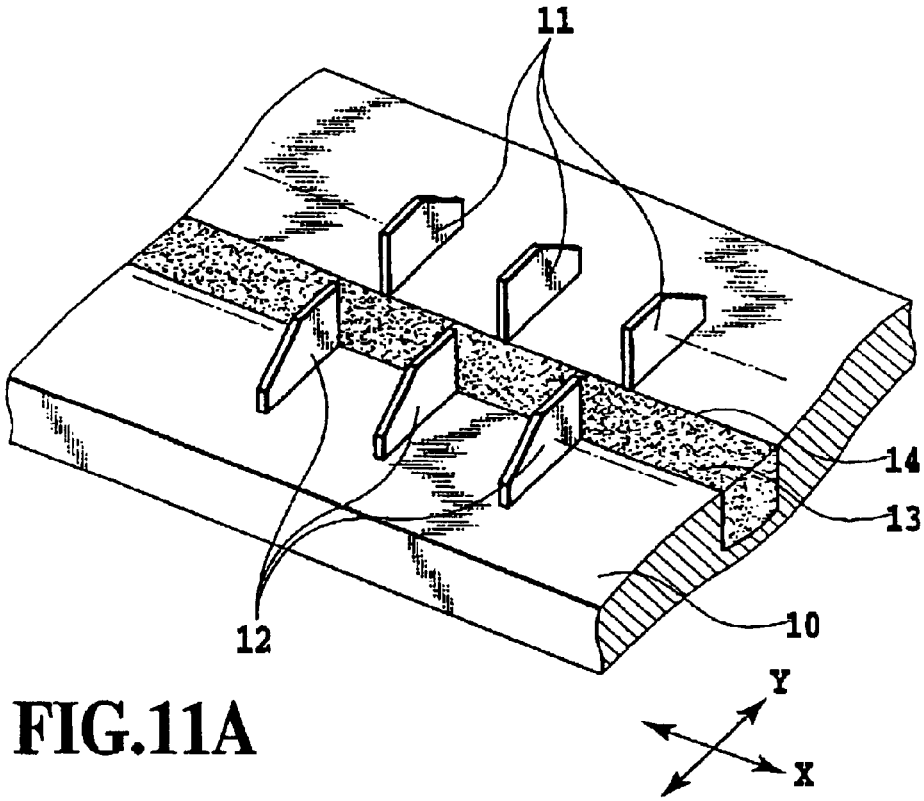
FIG. 11A is a partial perspective view showing a shape of a platen applied to an embodiment with a construction characteristic of the invention.
Figure 11B:
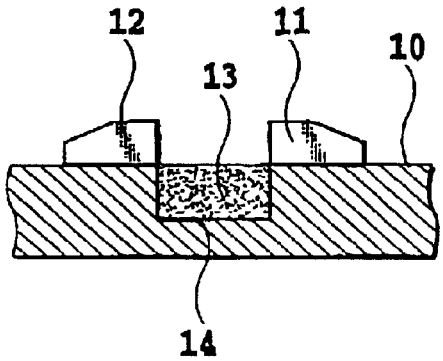
FIG. 11B is a vertical, partial cross-sectional side view showing a shape of a platen applied to an embodiment with a construction characteristic of the invention.

FIG. 11 shows a construction of a platen used in this embodiment. In FIG. 11, a platen 10 horizontally disposed and facing a print head H1001 that moves together with a carriage M4001 has upwardly protruding ribs 11, 12. A print medium P is therefore supported on upper end faces of the ribs 11, 12 as it is fed in a direction Y (subscan direction) in the figure by feed rollers (not shown). Between the ribs 11 and the ribs 12 there is a groove 14 (also referred to as an ink receiver) which receives a waste ink ejected at, positions outside the end of the print medium during the marginless printing performed at the end of the print medium. An ink absorber (also referred to as a platen ink absorber) 13 is held in the lower part of the groove 14 between the ribs.

Figure 12A:
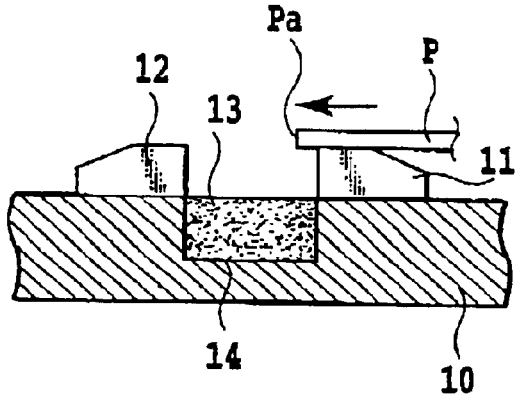
FIG. 12A is an explanatory vertical side view showing a marginless printing at a front end portion of a print medium on the platen of FIG. 11A, with the front end portion having reached a groove between ribs.
Figure 12B:
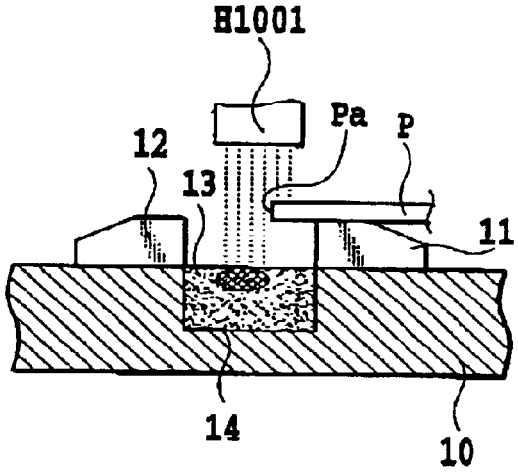
FIG. 12B is an explanatory vertical side view showing a marginless printing at a front end portion of a print medium on the platen of FIG. 11A, with ink droplets ejected toward the front end portion and an ink absorber.
Figure 12C:
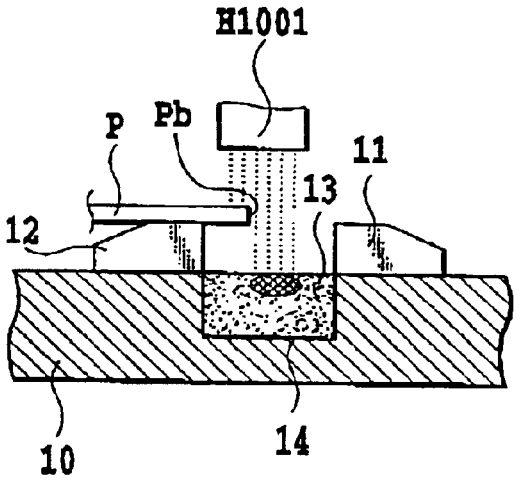
FIG. 12C is an explanatory vertical side view showing a marginless printing at a rear end portion of a print medium on the platen of FIG. 11A, with ink droplets ejected toward the rear end portion and an ink absorber.

In this embodiment having the above-described platen 10 and its associated structure, the marginless printing is performed at the ends of the print medium P in a procedure shown in FIG. 12.

As already shown in the basic construction, the ink jet printing apparatus of this embodiment intermittently feeds the print medium in the subscan direction in synchronism with the printing operation of the print head H1001 in the main scan direction (direction X). At the beginning of the print operation the print medium P is fed to the platen 10 by a feed mechanism. At this time, a front end portion Pa of the print medium P thus fed is stopped above the groove 14 formed between the ribs 11 and the ribs 12 formed on the upper surface of the platen 10 (see FIG. 12A).

Next, the carriage M4001 mounting the print head H1001 is moved in the main scan direction X while at the same time ejecting ink droplets from the print head H1001 onto the print medium P to perform printing on the front end portion Pa of the print medium P (see FIG. 12B) The print data used for this printing operation has a size larger than the print medium P. Therefore, the ink ejection according to the print data is performed up to a position beyond the front end Pa of the print medium P thus reliably forming an image on the print medium P to its front end Pa. Since the ink is ejected at positions outside the front end Pa of the print medium P, the ink (waste ink) ejected at positions where the print medium P does not exist lands on and is absorbed by the ink absorber 13 (platen ink absorber) provided between the ribs 11 and the ribs 12.

Also, for the printing at the left and right ends of the print medium, as in the printing operation at the front end portion of the print medium, print data of a size larger than the print medium is supplied. Based on this print data, ink is reliably ejected onto the left and right ends of the print medium P and also onto those positions deviated sideways from the left and right ends of the print medium P. The ink (waste ink) ejected onto the positions deviated sideways from the print medium P is also absorbed and retained in the ink absorber 13 (platen ink absorber) provided on the platen 10.

Next, after one line has been printed, an LF roller M3001 in the feed mechanism is rotated to move the print medium P in the feed direction Y, followed by the similar printing operation. Then, a rear end portion Pb of the print medium P that has reached the platen 10 is stopped above the groove 14 and subjected to the printing. In this printing operation on the rear end portion, too, print data of a size larger than the print medium P is supplied and, according to this print data, ink is ejected reliably onto the rear end portion Pb and also onto positions beyond the rear end portion Pb of the print medium P. The ink ejected onto positions beyond the rear end Pb is also absorbed and retained in the ink absorber 13 (platen ink absorber) provided on the platen 10 (see FIG. 12C).

In this embodiment, since the ink ejected onto positions outside the print medium P (waste ink produced by the marginless printing) lands on the platen ink absorber, the interior of the ink jet printing apparatus (such as platen) can be prevented from being smeared by the waste ink. Further, because the print medium P is supported on the upper end faces of the ribs 11, 12 as it is fed, the print medium P does not come into contact with the platen ink absorber situated below and the back surface of the print medium P is not smeared.

When the marginless printing as described above is performed and if the ink (waste ink) ejected onto the ink absorber 13 exceeds a predetermined regulating volume (absorption limit), the waste ink may overflow from the ink absorber 13. To reduce the possibility of this ink overflow, the first embodiment executes the following waste ink management. That is, in the first embodiment, every time the marginless printing is performed on one print medium, a predetermined values representing the amount of waste ink produced by one marginless printing operation is sent only once to a counter which cumulatively counts up the received value to produce an accumulated count value (total amount of waste ink). The accumulated count value (total amount of waste ink) is checked so that the total amount of waste ink falling onto the ink absorber 13 will not exceed the predetermined regulating volume (absorption limit). A waste ink volume information retrieving means, which retrieves information on the amount of waste ink produced by a single marginless printing and transfers this information to a counter, and the counter, which cumulatively adds up (accumulates) the information (predetermined value) transferred from the waste ink volume information retrieving means, are collectively called a waste ink volume accumulating means.

In this embodiment, each time the marginless printing is performed on one print medium (i.e., one marginless printing operation is done), a predetermined value is added to the counter. Considering the fact that the amount of waste ink ejected outside the print medium differs depending on an image being formed, it is possible to adopt a configuration which, rather than adding up a predetermined value, calculates the amount of waste ink corresponding to the image being printed for every marginless printing and adds up the calculated value. The first embodiment, however, puts emphasis on a simple construction capable of managing the waste ink volume and thus sets the amount of waste ink produced by the single marginless printing as the "predetermined value" and adds up this set value. The reason for representing the amount of waste ink by a constant "predetermined values" will be explained in the following.

In the marginless printing, there are ink droplets landing on near the ends of the print medium. It is difficult to precisely identify which of these ink droplets lands on the end portions of the print medium or the platen ink absorber. This is because the print medium fed in coordination with the printing operation does not necessarily move accurately along an ideal feed path and may in some cases move in a slantwise attitude following a feed path deviated from the ideal one. In that case, the positions of ink droplets that fall outside the print medium change, which in turn causes the amount of ink (the amount of waste ink) that lands on the platen ink absorber to differ from an estimated value. It is thus difficult to strictly control the amount of ink that reaches the platen ink absorber. If one wishes to strictly control the amount of ink that reaches the platen ink absorber, it is necessary to strictly control the state in which the print medium is fed, such as the degree to which the print medium is slanted. To strictly control the medium feeding state requires a complex control process including detection of the print medium feeding state. Further, the strict control of the waste ink volume requires precisely counting the number of ink droplets ejected outside the print medium. Such count processing makes the management of the waste ink volume complicated and increases the cost. Such complex management processing and cost increase should be avoided as much as possible.

Hence, in this embodiment, to control the amount of waste ink without requiring complex management processing, the amount of waste ink produced by one marginless printing operation is fixed as a "predetermined value" in advance and this "predetermined value" is added up for each execution of the marginless printing. To reliably prevent a possible ink overflow from the platen ink absorber, it is preferred that the maximum possible waste ink volume that is considered likely in one marginless printing operation be taken as the "predetermined value." With this arrangement. there is no need to calculate the waste ink volume for each marginless printing, except to simply add up constant predetermined values, thus making it possible to determine the amount of waste ink produced by the marginless printing without requiring complicated management processing. Further, since the predetermined value is added up once each time the marginless printing is executed for one print medium, the processing time to calculate the total waste ink volume can be shortened and the processing simplified, compared with those reguired in a configuration in which the amounts of waste ink ejected at the top, bottom, left and right ends of the print medium are individually calculated. Further, by defining the maximum waste ink volume considered possible in one marginless printing operation as the predetermined value described above, the total volume of waste ink can be reliably prevented from exceeding the predetermined regulating volume (absorption limit). In this case, not only can the possibility of ink overflow be reduced, but it can reliably be prevented.

The amount of waste ink from the recovery operation, such as preliminary ejection and nozzle suction, can be managed relatively easily since the amount of waste ink used in a single preliminary ejection operation or in a single nozzle suction operation is already specified.

Figure 13:
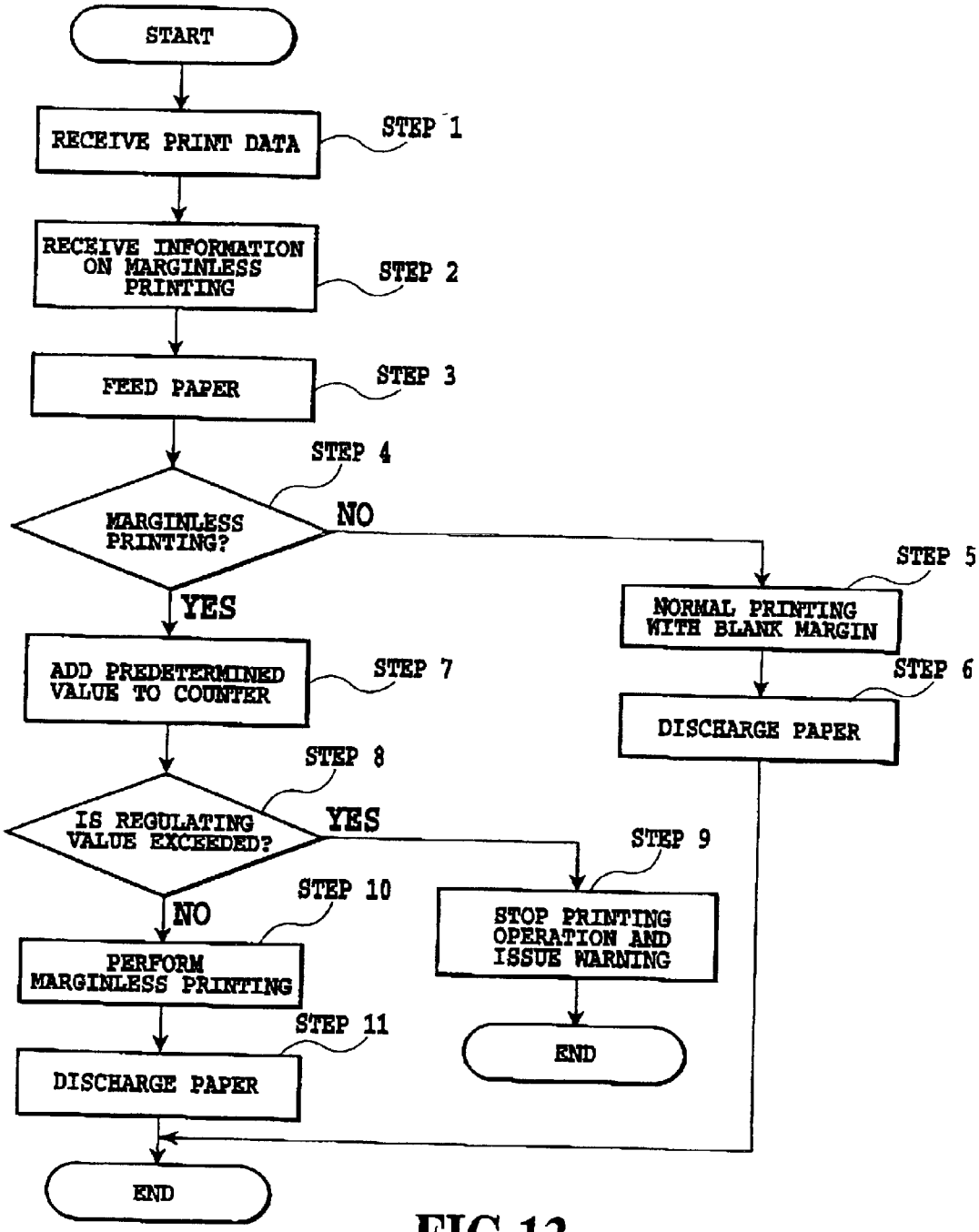
FIG. 13 is a flow chart showing a waste ink management operation according to first and second embodiments of the invention.

FIG. 13 is a flow chart showing the waste ink management procedure in the first embodiment.

In FIG. 13, when print data is received from a host computer, the paper feed mechanism is started. Along with the print data, the host computer also supplies information representing whether the printing operation to be executed is marginless printing or not (step 1, 2, 3).

Next, when it is decided from the information received that the print data is not for the marginless printing (step 4), a normal printing operation is performed (step 5), followed by a paper discharge operation (step 6). When at step 4 the print data is found to be intended for the marginless printing, the waste ink volume information retrieving means retrieves information on the amount of waste ink produced by a single marginless printing (here, a predetermined value) and transfers this predetermined value to the counter once. The counter (adding means) provided in a control unit adds up the predetermined value once (step 7). This counter cumulatively adds up the predetermined value (i.e., the amount of waste ink produced by one marginless printing operation) each time the marginless printing is performed on one print medium. Thus, the accumulated value or total value of this counter is equivalent to the total amount of waste ink. Checking the accumulated value or total value of this counter allows for the management of the total volume of the waste ink. In this embodiment, as already mentioned, the waste ink volume accumulating means includes the waste ink volume information retrieving means and the counter.

In this first embodiment, the predetermined value to be added to the counter is preferably set equal to the largest volume of waste ink that is considered possible in connection with the prevention of ink overflow from the ink absorber 13. For this setting, the following parameters may be used:

Maximum medium size (M1×M2): A4 (210 mm×297 mm)

Maximum overrunning width (T): 3 mm each for front, rear, left and right end

Maximum volume of ink ejected (E): 5 ng

Maximum print duty (D); 240%

The maximum medium size (M1×M2) means a maximum size of a print medium that can be used in the printing apparatus. Here, A4 size is used. The width over which the printing is performed beyond the edges of the A4-size print medium is defined as the maximum overrunning width (T). The maximum volume of ink ejected (E) indicates the maximum volume of an ink droplet ejected by a single ejection operation. The maximum print duty (D) means the maximum number of dots that can land on the medium in a unit area. In this embodiment, the printing resolution is set to 1200 dpi; a unit area 1/1200 inch square is defined as one pixel; and when one dot is applied to each of all pixels on the print medium, the print duty is said to be 100%. Hence, a print duty of 240% means a printing in which on average 2.4 ink dots fall on each of all pixels. The maximum print duty depends on an ink penetrating ability, an ink absorption capability of a print medium, and a required print density, and, in this apparatus, is set to 240%.

Figure 16:
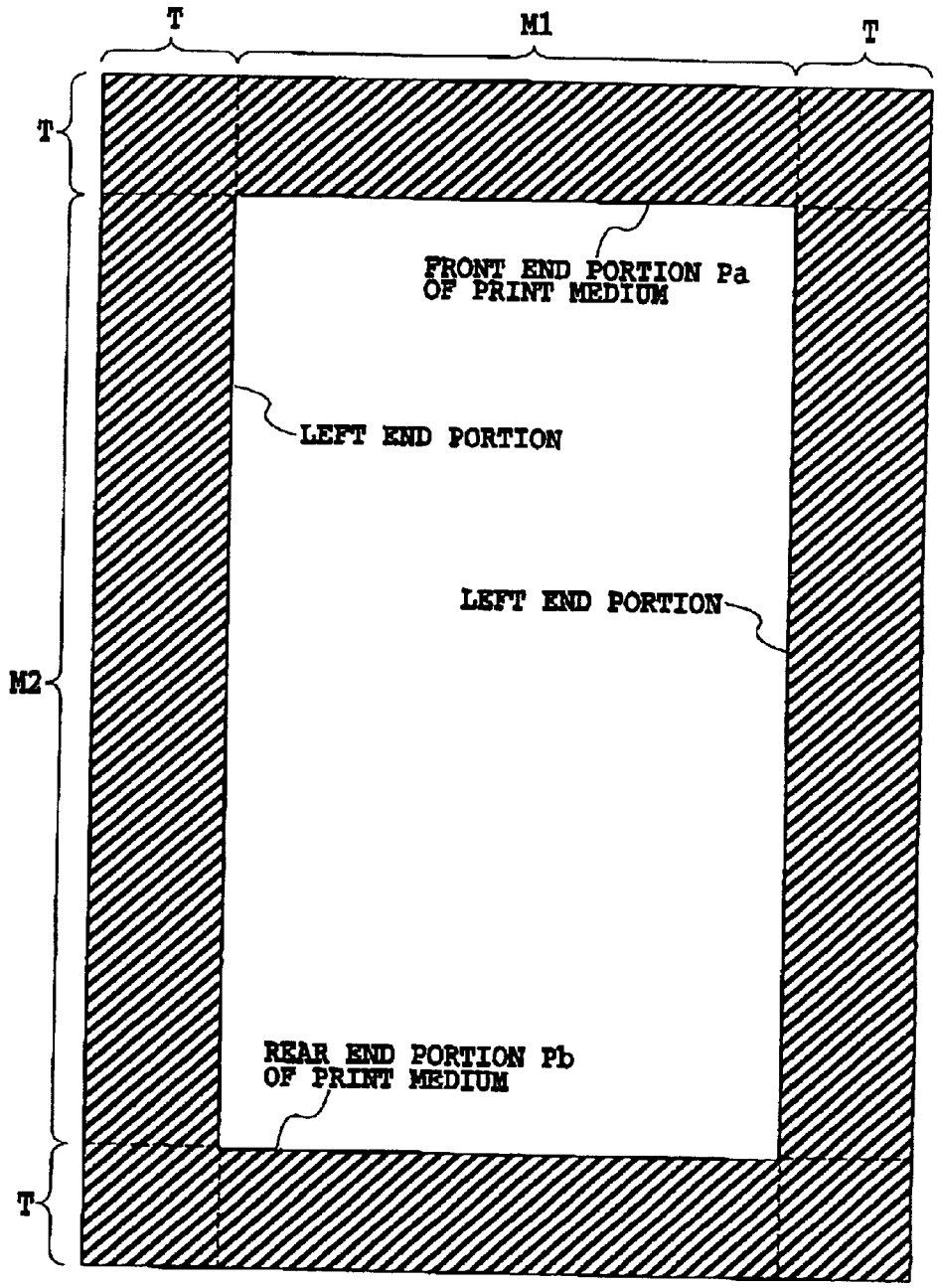
FIG. 16 is an explanatory diagram showing an example method of calculating a predetermined value to be added to a counter according to a medium size, an overrunning width beyond medium ends, an amount of ink ejected, and a print duty.

Based on these parameters, the maximum amount of waste ink ejected outside the print medium (Vmax) can be calculated. More specifically, an overrunning area ($mm^2$) corresponding to a shaded portion in FIG. 16 is determined by calculating:

$$S = \text{Print data size (width}\times\text{length)} - \text{Print medium size (width}\times\text{length)}.$$

This is rewritten as:

$$\text{Overrunning area } S = ((T+M1+T)\times(T+M2+T)-(M1\times M2)).$$

Next, the maximum number of ink droplets X ejected onto the overrunning area ($mm^2$) is determined. Since the printing resolution is 1200 dpi (dots/inch), one inch is 25.4 mm and the maximum print duty is D %, then the maximum number of droplets $X=S\times(25.4/1200)^2\times(D/100)$.

As a last step, the maximum number of ink droplets X is multiplied by the maximum ejection volume of each droplet (E), i.e., Vmax=X ×E, to calculate the maximum amount of waste ink falling outside the print medium (Vmax).

To summarize, the maximum amount of waste ink Vmax determined from the parameters explained above is expressed as $$\begin{aligned} V\max &= (T+M+T)\times(T+M2+T)-(M1\times M2)\times \\ &\quad (25.4/1200)^2\times(D/100)\times E \\ &= ((3+210+3)\times(3+297+3)-(210\times 297)\times \\ &\quad (25.4/1200)^2\times(240/100)\times 5 \\ &= 82441316 \text{ (ng)} \\ &= 8.24\times 10^7 \text{ (ng)} \end{aligned}$$

This value is defined as a predetermined value in advance and is added to the counter each time the marginless printing is performed on one print medium. That is, in executing the marginless printing, this predetermined value is added only once to a value representing a previous total amount of waste ink accumulated up to the last marginless printing operation to determine a current total amount of waste ink accumulated up to the latest marginless printing operation. The maximum amount of ink that the ink absorber 13 can hold (absorption limit) is 50 g and this value is preset as a regulating value.

As described above, a check is made to see if the current accumulated value, which is obtained by adding the predetermined value Vmax once to the previous total volume of waste ink accumulated up to the last marginless printing operation, is in excess of the regulating value (here, $5\times10^{10}$ ng). If the accumulated value in the counter exceeds the regulating value of $5\times10^{10}$ (ng), the printing operation of the printer is stopped to prevent the printer from printing on the print medium (step 9). As a result, an overflow of the waste ink from the ink absorber 13 can be prevented reliably. When the current accumulated value in the counter is in excess of the regulating value, it is preferred that some indication be made to prompt the user to replace the ink absorber. On the other hand, when at step 8 it is decided that the accumulated value in the counter is not in excess of the regulating value, the marginless printing is executed (step 10), followed by the discharging of the print medium (step 11).

In this first embodiment, as illustrated in the flow chart of FIG. 13, before executing the marginless printing (step 10), a "predetermined value" equivalent to the amount of waste produced by one marginless printing operation is added to the counter (step 7) to see if the accumulated value after the addition operation exceeds the regulating value (step 8). With this arrangement, it is possible to know, before actually executing the marginless printing, whether there is a possibility of the ink overflowing from the ink absorber. Furthermore, if the possibility of ink overflow from the ink absorber exists (i.e., the accumulated value after addition operation exceeds the regulating value), a control is executed not to perform the marginless printing, thereby reliably preventing the ink overflow.

According to the first embodiment described above, since the total amount of waste ink is calculated by adding the predetermined waste ink volume (predetermined value) generated by one marginless printing operation to the counter only once each time the marginless printing is performed on one print medium, the processing time to calculate the total waste ink volume can be shortened and the processing simplified, compared with those required in a configuration in which the amounts of waste ink ejected at the top, bottom, left and right ends of the print medium are individually calculated. Further, since the maximum waste ink volume considered possible in one marginless printing operation is set as the predetermined value equivalent to the waste ink volume produced by one marginless printing operation, it is possible to reliably prevent the total volume of waste ink from exceeding the predetermined regulating volume (absorption limit). This ensures that an ink overflow can be reliably prevented.

(Second Embodiment)

In the first embodiment, regardless of the size of a print medium, a constant value is used as a "predetermined value" which is added up each time one marginless printing operation is performed. More specifically, the "predetermined values" is assigned a maximum amount of waste ink that is considered possible when a print medium of a maximum size (A4 size) for this printing apparatus is used. This configuration has an advantage of being able to reliably prevent an overflow of waste ink from the ink absorber. However, it has the following disadvantage. That is, when a print medium smaller than the maximum A4 size (for example, A5 size) is used, the actual amount of waste ink produced by one marginless printing operation is smaller than the above-described predetermined value, so that what needs to be added up as the waste ink volume can be a smaller value than the above-described predetermined value. In the first embodiment, however, because a constant predetermined value is used whatever the size of the print medium, it may undesirably be decided that the accumulated total amount of waste ink has exceeded the regulating value (absorption limit) when in fact the total amount of waste ink is still at such a level as will not cause an ink overflow. As a result, the printing operation is forced to stop. Although this configuration may be considered desirable when viewed from a standpoint of reliably preventing an ink overflow from the ink absorber, the number of times that the ink absorber needs to be replaced increases. If importance is given to a reduction in the number of times that the ink absorber is replaced, it is desired that the total amount of waste ink be allowed to come close to, but not exceeding, the regulating value.

Thus, rather than using a constant predetermined value as a value that is added up each time one marginless printing operation is executed, the second embodiment uses a plurality of different predetermined values corresponding to different sizes of print media. That is, the predetermined value to be added is changed according to the size of a print medium. In more concrete terms, when the ink jet printing apparatus receives information on the size of a print medium the user has selected in a driver menu on a display of a host computer, the apparatus refers to a table (data table as shown in Table 1 below) that relates print medium sizes to associated predetermined values and, based on the size information received, picks up a predetermined value that matches the size of the print medium used. The predetermined value thus selected is then used for the addition operation.

The flow chart for managing the waste ink volume in this second embodiment is almost the same as that explained with reference to FIG. 13. So the drawing for this flow chart is omitted. What differs from the first embodiment is that, in step 1 and 2 of FIG. 13, the second embodiment receives another information on the print medium size in addition to the print data and the information indicating whether the print data is intended for the marginless printing; that in step 4, in addition to checking whether the printing to be executed is a marginless printing, another check is made to determine the size of the print medium; and that step 7, rather than adding a constant predetermined value regardless of the size of the print medium, adds up a predetermined value corresponding to the size of the print medium. More specifically, the waste ink volume information retrieving means retrieves a predetermined value that matches the size of the print medium. Then, the predetermined value thus picked up is transferred once to the counter, which (addition means) adds up the predetermined value received.

Predetermined values as related to print medium sizes are shown in Table 1 below. The "predetermined values," each of which is equivalent to the waste ink volume produced by one marginless printing operation, are assigned different values for different medium sizes. Here, as the size of the print medium increases from L-size to postcard, A5 and A4, the predetermined value corresponding to each of these sizes increases from X4 to X3, X2 and X1. As described above, the reason that in this second embodiment the predetermined value is made to change according to the size of the print medium is to perform the waste ink volume management with a higher precision than in the first embodiment. That is, the overrunning area S varies depending on the size of the print medium and thus the "predetermined values" corresponding to the waste ink volume produced by one marginless printing operation also varies. To ensure a highly precise waste ink volume management, it is far more advantageous to add an optimum predetermined value that matches the size of the print medium than to use a constant predetermined value that does not consider the size of the print medium. The addition of any of these predetermined values is performed only once, as in the first embodiment, each time the marginless printing is executed on one print medium.

TABLE 1

| Size of print medium (mm × mm) | Predetermined value |
|---|---|
| A4 (210 × 297) | X1 (> X2) |
| A5 (148 × 210) | X2 (> X3) |
| Postcard (100 × 148) | X3 (> X4) |
| L-size (89 × 127) | X4 |

As described above, in this second embodiment, a plurality of different predetermined values that match the corresponding sizes of the print mediums are provided as "predetermined values" each of which is used in the addition operation for each marginless printing on one print medium, so that an optimum predetermined value can be added according to the size of the print medium used. This arrangement ensures a precise control of the waste ink volume, compared with a configuration in which a constant predetermined value is added at all times without regard to the size of the print medium. As a result, the total amount of waste ink is allowed to come close to, but not exceeding, the absorption limit (regulating value) of the ink absorber, thereby reducing the number of times that the ink absorber needs to be replaced.

(Third Embodiment)

This third embodiment is characterized in that a value (addend) that is added up for each marginless printing operation is determined according to at least a kind of print medium (plain paper, glossy paper, coated paper, etc.) or a print mode (high-speed mode, standard mode, high-quality mode, etc.). In this embodiment, since the amount of ink ejected varies depending on the kind of print medium and the print mode, which in turn changes the amount of waste ink ejected outside the print medium, the addend is determined by taking the kind of print medium and the print mode into account.

Now, the third embodiment will be described by referring to FIG. 14. This embodiment, too, has the same basic construction as that of the first embodiment shown in FIGS. 1 through 10, and also the construction of the platen 10 as shown in FIG. 11 and FIG. 12.

Figure 14:
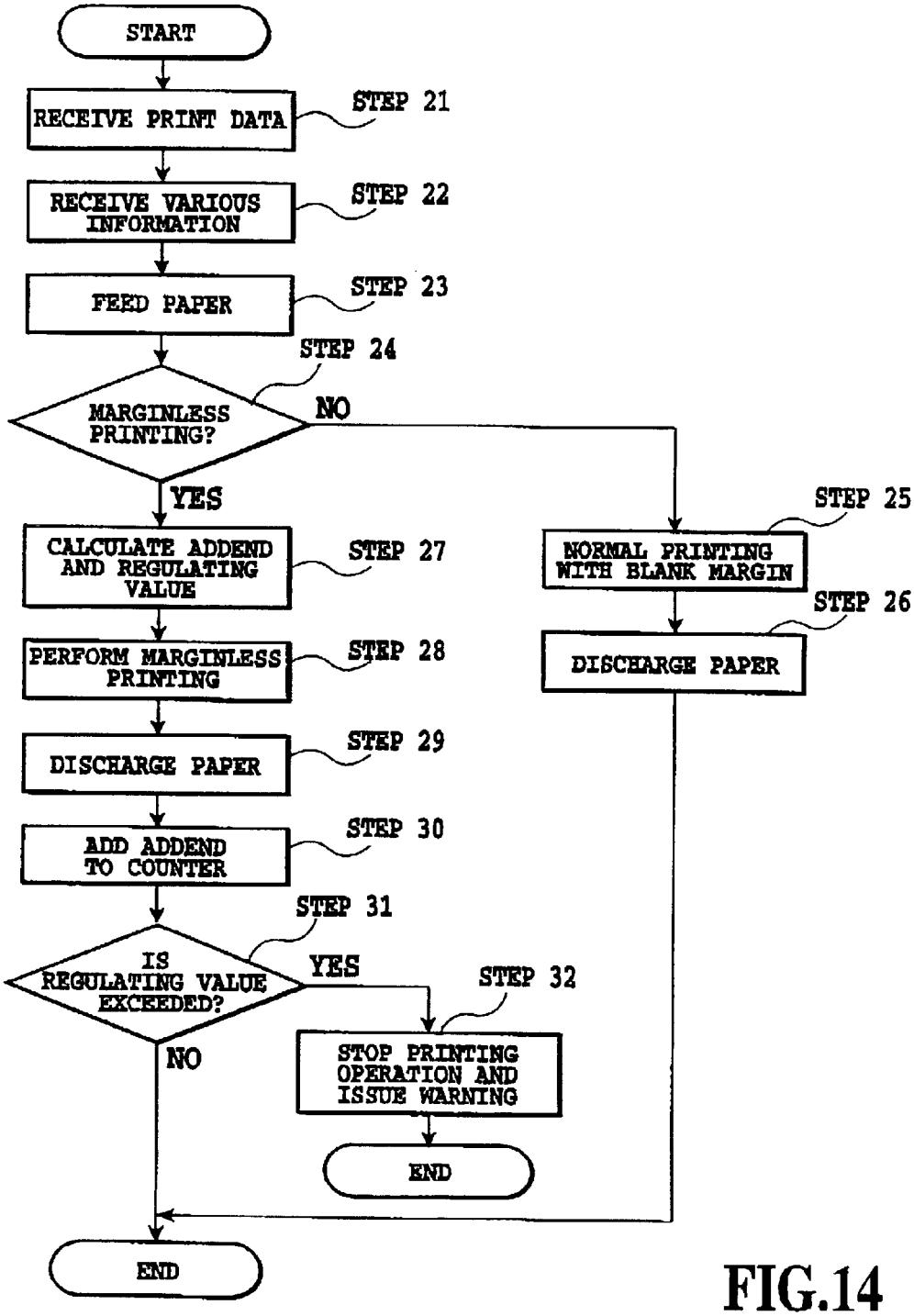
FIG. 14 is a flow chart showing a waste ink management operation according to a third embodiment of the invention.

The waste ink volume management procedure that is activated when the ink jet printing apparatus of this invention performs the marginless printing will be describe with reference to a flow chart of FIG. 14.

When the printing apparatus receives print data from the host computer, the feed mechanism is started, feeding a print medium P to the platen 10. At this time, in addition to the print data, the host computer also supplies to the printing apparatus a kind of print medium used, a print mode, information indicating whether the printing to be performed is a marginless printing or not, a size of the print data (length and width) and a size of the print medium (length and width) (step 21, 22, 23). As shown in Table 2 and Table 3 below, it is assumed that the kind of print medium includes plain paper, glossy paper and coated paper, and that the print mode includes mode 1, mode 2, mode 3, mode 4 and mode 5.

Figure 17A:
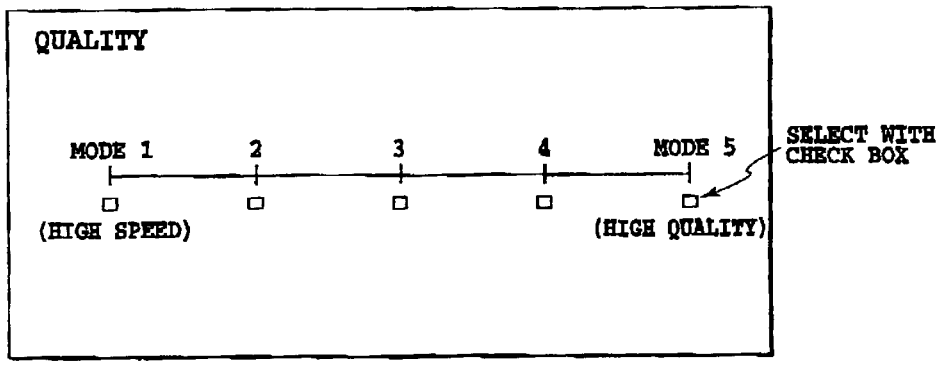
FIGS. 17A and 17B are driver menus shown on a display of a host computer for setting a print mode.

Here, the print mode will be explained in detail. In this embodiment a print mode is set by a user manipulating a user interface screen (driver menu) on a display of the host computer. For example, a display presents to the user a driver menu, as shown in FIG. 17A, on which the user can select a desired quality to set a corresponding print mode. Here, mode 1 is a high-speed mode that puts emphasis on the printing speed rather than quality. As the mode changes to mode 2, mode 3 and mode 4, the printing speed decreases but the print quality increases. Mode 5 is a high-quality mode capable of producing a highest print quality although the printing speed is slow. In this way, the third embodiment makes available for selection five print modes with different qualities and speeds, allowing the user to set the quality and speed in five different levels.

Figure 17B:
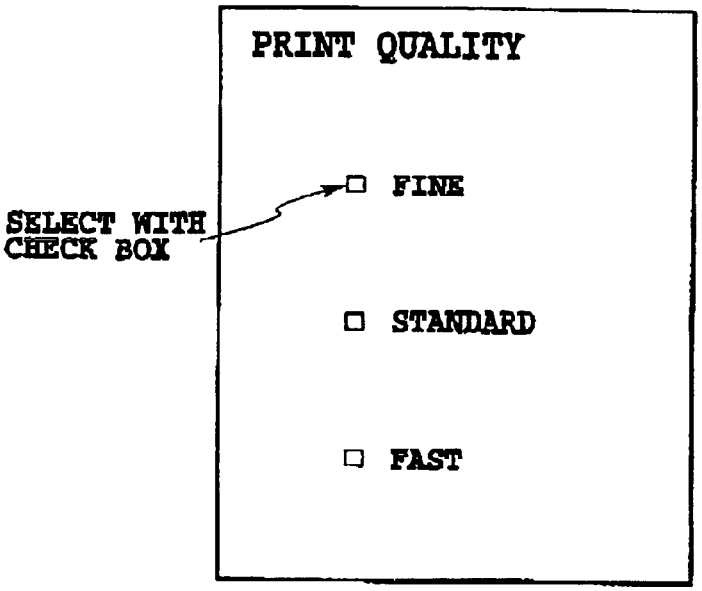

Further, as shown in the display screen of FIG. 17B, an arrangement may be made to allow the user to set one of three levels, "fast," "standard" and "fine." In this case, it is preferred that the "fast," "standard" and "fine" settings be matched to the above-described print modes. For example, selecting the "fast" mode sets mode 1 (high-speed mode), selecting the "standard" mode sets mode 3 (standard mode) and selecting the "fine" mode sets mode 5 (high-quality mode). These print modes are set by selecting a check box on the display screen of FIG. 17.

As described above, the high-quality mode provides a slower printing speed but a higher print quality than the high-speed mode. This is because in the high-quality mode a larger number of main scans (passes) of the print head are performed than in the high-speed mode. Increasing the number of passes results in an increased number of nozzles being used in forming a single line, which in turn alleviates variations in the volume of ink ejected from nozzles and thereby reduces density variations to that extent. In this way, as the mode gives greater importance to the print quality, the number of passes is increased up to the maximum provided by the high-quality mode (mode 5). On the contrary, as the mode puts greater emphasis on the printing speed, the number of passes is reduced down to the minimum provided by the high-speed mode (mode 1).

Further, in this embodiment, as shown in Table 2 the maximum amount of ink ejected (maximum print duty) is changed according to the print mode. More specifically, the high-quality mode (mode 5) is given a greater ink ejection amount than-the high-speed mode (mode 1). This is because, as the maximum ink ejection volume increases, the amount of ink available for medium printing increases thus improving a print density, one of important parameters of the print quality. If, in the high-speed mode (mode 1) with a small number of passes, the maximum ejection volume is increased, a large volume of ink is delivered to the print medium in a short period of time, so that the print medium cannot absorb ink, causing ink to spread, degrading the print quality significantly. Therefore, in the high-speed mode (mode 1) with a small number of passes, the maximum ejection volume cannot be set large and is set at a value smaller than that of the high-quality mode (mode 5).

As shown in Table 2 in this embodiment, not only is the maximum print duty (%) changed according to the print mode but it is also changed depending on the kind of print medium (plain paper, glossy paper, coated paper). The reason for differentiating the maximum print duty (%) among the plain paper, glossy paper and coated paper is that these print mediums have different ink absorbing capabilities. Take mode 1, for example. The coated paper has a relatively high ink absorbing capability and thus is set with a maximum ejection volume of 240%. The plain paper, on the other hand, has a smaller ink absorbing capability, so that setting the maximum ejection volume at 240% will result in ink spreading. Thus, the maximum ejection volume for the plain paper is set at 180%, which is lower than the value for the coated paper.

TABLE 2

| Maximum print duty (%) | | | |
|---|---|---|---|
| | Kind of medium | | |
| Print mode | Plain paper | Glossy paper | Coated paper |
| Mode 1 | 180(%) | 200(%) | 240(%) |
| Mode 2 | 180(%) | 200(%) | 240(%) |
| Mode 3 | 180(%) | 200(%) | 240(%) |
| Mode 4 | 200(%) | 200(%) | 240(%) |
| Mode 5 | 200(%) | 220(%) | 240(%) |

TABLE 3

| Setting values | | | |
|---|---|---|---|
| | Kind of medium | | |
| Print mode | Plain paper | Glossy paper | Coated paper |
| Mode 1 | 9 | 10 | 12 |
| Mode 2 | 9 | 10 | 12 |
| Mode 3 | 9 | 10 | 12 |
| Mode 4 | 10 | 10 | 12 |
| Mode 5 | 10 | 11 | 12 |

At step 24 of FIG. 14 a check is made based on the data supplied from the host computer to ascertain whether the print data is intended for the marginless printing. If the print data is found to be not intended for the marginless printing, a printing operation that leaves blank margins along the edges of the print medium (so-called normal printing) is performed according to a selected print mode, followed by the discharging of the print medium. Then the operation is stopped. If on the other hand the step 24 decides that the print data is intended for the marginless printing, the printing apparatus references a table having setting values for each print mode and for each kind of print medium, as shown in Table 3, selects a setting value according to the received information on the kind of print medium and on the print mode, and, based on the selected setting value, calculates a value (addend) to be added to the counter (step 27). The value to be added to the counter is calculated as follows.

In calculating the addend, the overrunning area S is first determined by calculating the following equation: Overrunning area S=(Print data width×Print data length)−(Print medium width×print medium length). Then, the overrunning area S is multiplied by the setting value determined from the kind of print medium and the print mode to calculate the addend to be added up for each marginless printing operation. To prevent an ink overflow from the ink absorber, it is desired that a value equivalent to the maximum waste ink volume that can actually be ejected be used as the setting value. In this third embodiment, the maximum ejection volume in a single ejection operation is 5 ng and the maximum print duty is determined as shown in Table 2 according to the kind of print medium and the print mode. Hence, the setting value (the maximum possible value) can be expressed as follows using the maximum print duty, which is determined from the kind of print medium and the print mode, and also the maximum ejection volume of 5 ng.

Setting value=Maximum print duty (%)/100×Maximum ejection volume (5 ng).

The values obtained from the above equation using Table 2 and the maximum ejection volume are equivalent to the setting values shown in Table 3.

After the addend (overrunning area S×setting value of Table 3) has been calculated in this manner, the marginless printing at the ends of the print medium is started (step 28). After the printing operation is finished and the print medium discharged (step 29), the addend calculated as described above is sent by the waste ink volume information retrieving means to the counter, which adds the addend to the existing value (step 30).

Then, a check is made to see if the accumulated value in the counter is in excess of the regulating value ($5\times10^{10}$ ng as in the first embodiment) (step 31). If the regulating value is not exceeded, the control operation is ended. If it is exceeded, the control operation issues a warning to the user (step 32) before being terminated.

In the above example the addend has been described to be calculated by multiplying the setting value and the overrunning area S each time one marginless printing operation is executed. This embodiment is not limited to this configuration. For example, a table (Table 4) may be prepared in advance which relates addends (A1<A2<A3<A4), each to be added up for each marginless printing operation, to the kinds of print medium and the print modes. This table may be referenced to select an optimum addend, according to the kind of print medium and the print mode used. In other words, a plurality of different predetermined values corresponding to the kinds of print medium and the print modes are prepared beforehand as addends, each of which is to be added to the counter for each marginless printing operation, and an optimum predetermined value is selected for addition operation according to the kind of print medium and the print mode used. In this configuration, the multiplication process is not needed and thus the processing time can be shortened. A table 4 below shows addends when the overrunning area S is a predetermined area. It is needless to say that the addend changes according to the overrunning area S as described above. In this configuration, the waste ink volume information retrieving means retrieves a predetermined value corresponding to the kind of print medium and the print mode used and sends it to the counter. The counter (addition means) adds the predetermined value that matches the kind of print medium and the print mode to the existing count value.

TABLE 4

| Addends | | | |
|---|---|---|---|
| | Kind of medium | | |
| Print mode | Plain paper | Glossy paper | Coated paper |
| Mode 1 | A1 | A2 | A4 |
| Mode 2 | A1 | A2 | A4 |
| Mode 3 | A1 | A2 | A4 |
| Mode 4 | A2 | A2 | A4 |
| Mode 5 | A2 | A3 | A4 |

Further, the addend to be added up for each marginless printing operation has been described to be determined by both the kind of print medium and the print mode. The addend may be determined by at least the kind of print medium or the print mode. For example, if the ink ejection volume is not varied among different print modes but is varied according to the kind of print medium, the addend may be determined by only the kind of print medium without considering the print mode. On the other hand, if the ink ejection volume is not varied among different kinds of print medium but is varied according to the print mode, the addend may be determined by only the print mode without considering the kind of print medium.

Furthermore, the value (addend) to be added for each marginless printing operation changes depending on the overrunning area S, as described earlier. The overrunning area S also varies depending on the size of the print data and the size of the print medium. Hence, in addition to the kind of print medium and the print mode. the size of print data and the size of print medium are preferably taken into account in determining the addend. It is therefore possible to adopt a configuration in which a plurality of predetermined values determined by the kind of print medium, the print mode, the size of print data and the size of print medium are stored in a table in advance, in which this table is referenced to select one of the predetermined values according to the kind of print medium, the print mode, the size of print data and the size of print medium used, and in which the selected predetermined value is added up. In this configuration, the waste ink volume information retrieving means retrieves the predetermined value that matches the kind of print medium, the print mode, the size of print data and the size of print medium and sends it to the counter. The counter (addition means) adds the predetermined value received to an existing value.

As described above, with this third embodiment, since the value (addend) to be added up for each marginless printing operation is determined by taking the kind of print medium and the print mode into consideration, a more precise waste ink volume management can be realized than when the addend is determined without considering the kind of print medium or the print mode.

(Fourth Embodiment)

This fourth embodiment is characterized in that the value (addend) to be added for each marginless printing operation is determined based on the print duty. In this embodiment since the ink ejection volume varies depending on the print duty, which in turn causes the waste ink volume ejected outside the print medium to vary accordingly, the addend is determined by considering the print duty.

Now, by referring to a flow chart of FIG. 15, the fourth embodiment will be described. This embodiment, too, has the same basic construction as those of the preceding embodiments shown in FIGS. 1 through 10, and also the construction of the platen 10 as shown in FIG. 11 and FIG. 12.

Figure 15:
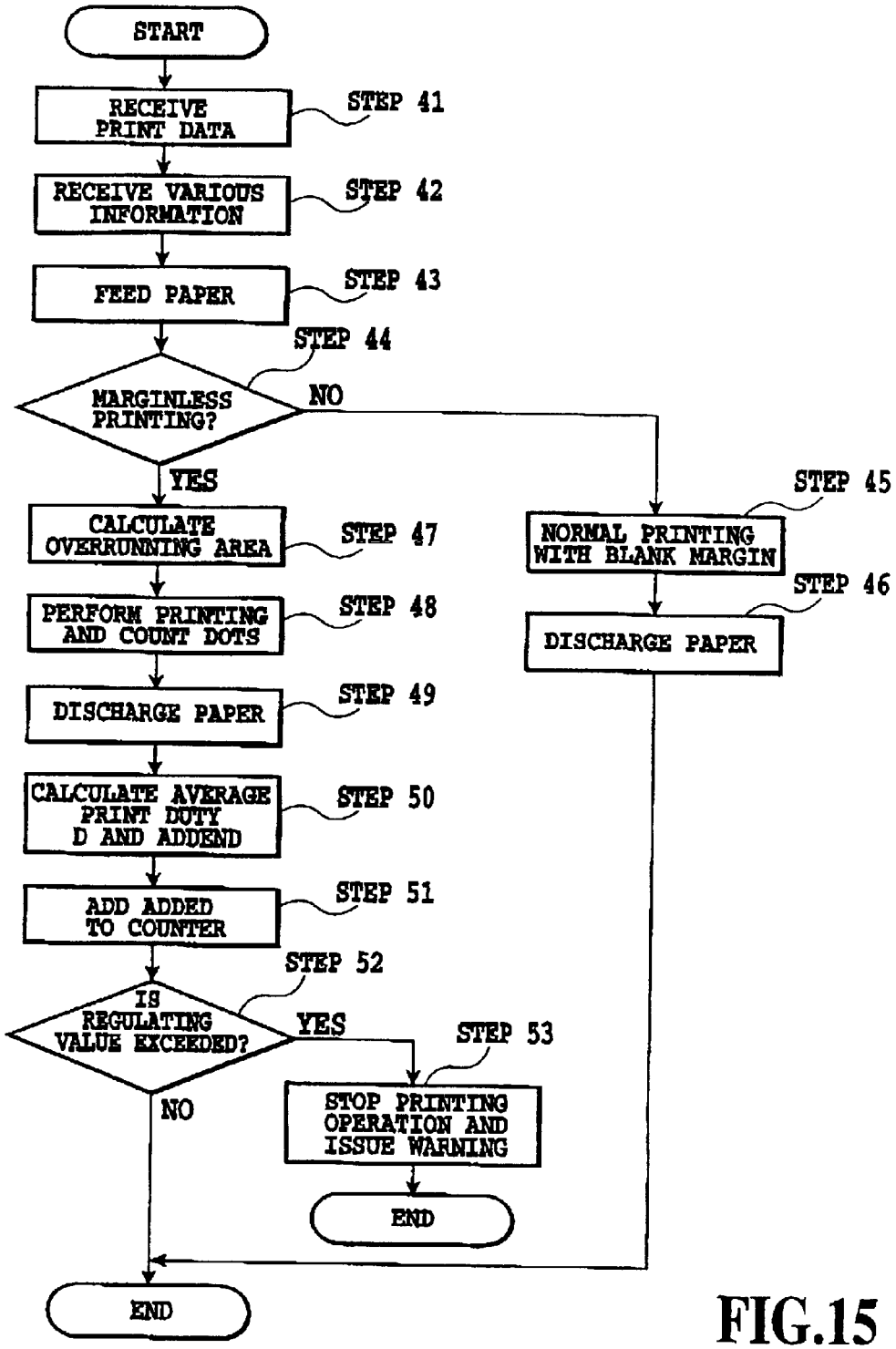
FIG. 15 is a flow chart showing a waste ink management operation according to a fourth embodiment of the invention.

Referring to FIG. 15, the waste ink volume management operation according to the fourth embodiment will be explained. When the printing apparatus receives print data from the host computer, the feed mechanism is started to feed a print medium P to the platen 10. At this time, in addition to the print data, the host computer also supplies to the printing apparatus information indicating whether the printing to be performed is a marginless printing or not, a size of the print data (length and width) and a size of the print medium (length and width) (step 41, 42, 43). At step 44, if it is decided that the print data is not intended for the marginless printing, the normal printing is performed (step 45), followed by the discharging of a print medium (step 46) and the termination of the control sequence. Further, if the stop 44 decides that the print data is intended for the marginless printing, the overrunning area S is calculated (step 47) from the following equation:

Overrunning area S=(Print data length×Print data width)−(Print medium length×Print medium width).

Next, based on the print data supplied from the host, the print head H1001 ejects ink to perform a required printing operation and at the same time the number of dots ejected during this printing operation is counted (step 48). When the printing operation is finished and the print medium discharged (step 49), an average print duty D is calculated from the number of dots counted and the size of the print data (area). This is obtained from the following equation:

D=Number of dots/Print data area

This value means an average number of dots per unit area.

Then, an addend is determined by multiplying the overrunning area S, the average print duty D and the ejection volume for one dot (in this fourth embodiment, 5 ng). The addend calculated here is transferred by the waste ink volume information retrieving means to the counter, which adds it to the existing count value (step 51). In the ink jet printing apparatus of this fourth embodiment, since the maximum ink holding volume (regulating value) that the ink absorber 13 in the platen 10 can absorb and hold is 50 g, if the ink absorber counter indicating the accumulated value after the addition operation is in excess of the regulating value ($5\times10^{10}$ ng), there is a possibility of the waste ink overflowing from the ink absorber 13. Hence, the printing operation is stopped and a warning is issued to the user (step 53) before terminating the waste ink volume control sequence.

In addition to the print duty, this embodiment may also consider other conditions in determining the addend. Conditions other than the print duty that may be considered include such conditions as specified in the third embodiment. That is, the addend may be determined by considering, in addition to the print duty, at least one of the following conditions: the kind of print medium, the print mode, the size of print data and the size of print medium.

As described above, since in the fourth embodiment the value (addend) to be added for each marginless printing operation is determined by taking the print duty into account, a more precise waste ink volume management can be realized than when the addend is determined without considering the print duty.

Further, the average print duty D may be calculated in an area more closely approximating the overrunning portion by allowing the user to arbitrarily set in the main scan direction and in the subscan direction the size and position of a range (print data area) in which to count the number of dots, or by using a specified dot count range designed primarily to calculate a power consumption. In this case, the average print-duty D can be expected to have an improved precision, contributing to a more precise management of the waste ink volume.

(Fifth Embodiment)

In this fifth embodiment, to determine the waste ink volume as accurately as possible, an addend equivalent to the waste ink volume produced by one marginless printing operation is calculated by counting the number of ink droplets ejected (N) in the overrunning area and multiplying the ink droplet number (N) with an ink ejection volume (E) of each droplet.

In this configuration, as described in the first embodiment, when there is a large print medium feeding error, the counted ink ejection number (N) may differ from the number of ink droplets actually ejected in the overrunning area. However, when the print medium feeding accuracy is high, the difference between the counted ink ejection number (N) and the number of ink droplets actually ejected in the overrunning area is small. Thus, in a printer that has a high feeding precision and can minimize the feeding error, the addend is preferably determined from the following formula:

Counted ink ejection number (N) in overrunning area×Ink ejection volume of each droplet (E) With this arrangement, the waste ink volume can be determined accurately.

(Sixth Embodiment)

This sixth embodiment has a function of adjusting an overrunning width shown shaded in FIG. 16. A procedure for changing the overrunning area by this function will be explained.

Figure 18A:
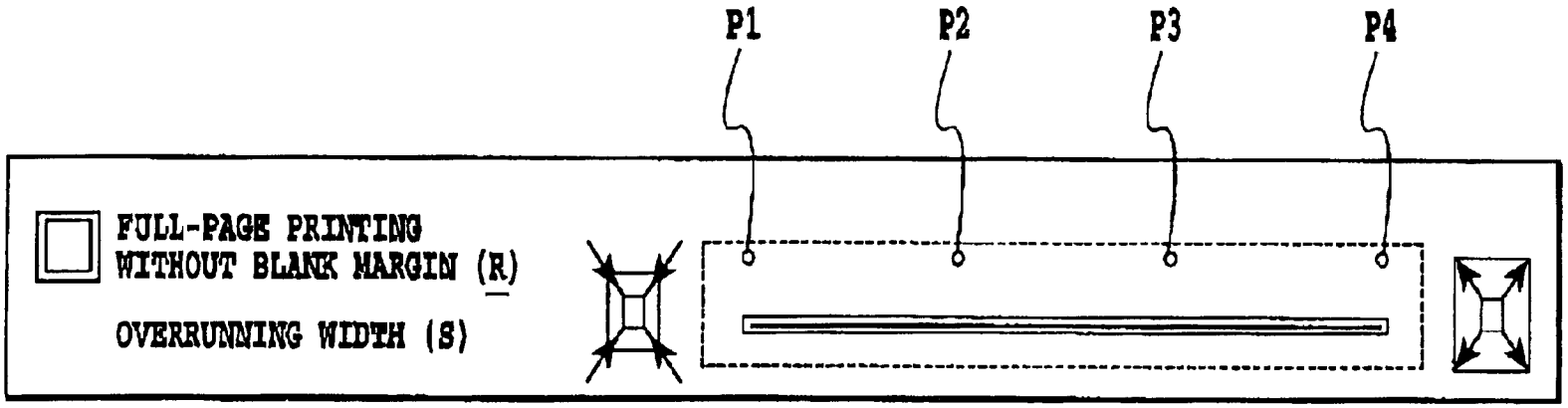
FIGS. 18A, 18B and 18C are explanatory diagrams showing functions for adjusting an overrunning width.
Figure 18B:
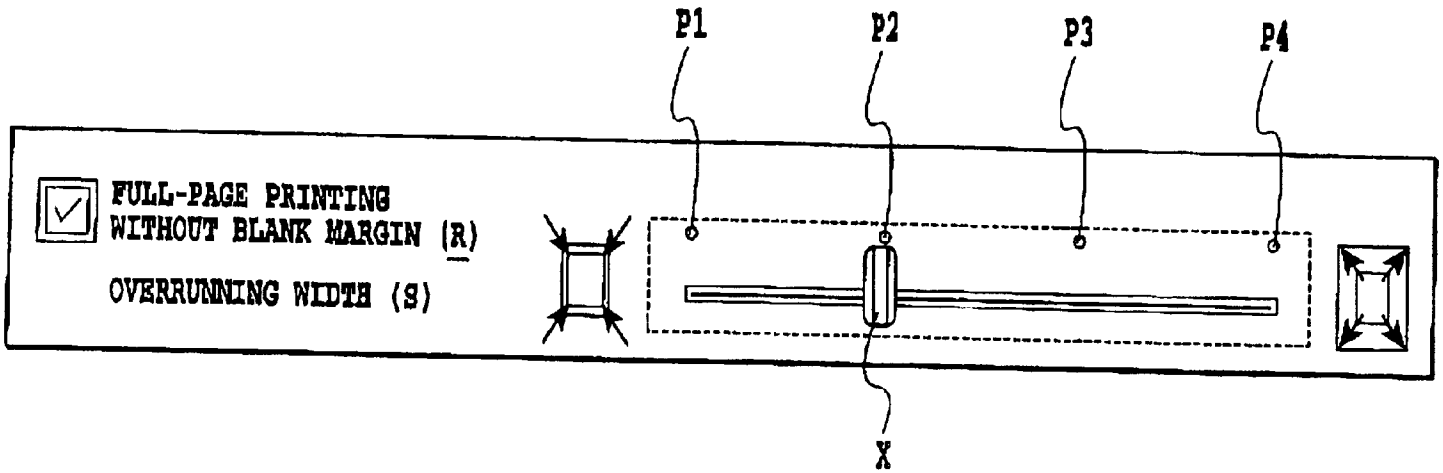

Referring to FIG. 18, the overrunning width adjusting function will be explained. FIG. 18 shows a user interface screen (a setting menu on a display of the host computer) for adjusting the overrunning width in this example, a user interface screen as shown in FIG. 18B is displayed for the user to specify the overrunning width. The overrunning width is specified, as detailed later, by the user selecting an overrunning width specification item as a setting item with a mouse pointer and then dragging a knob K on the screen to the right or left. A detailed specification procedure will be described later. When a marginless printing is not specified, a user interface screen as shown in FIG. 18A is displayed. On the screen of FIG. 18A the knob K is not shown and thus the overrunning width cannot be specified.

Figure 18C:
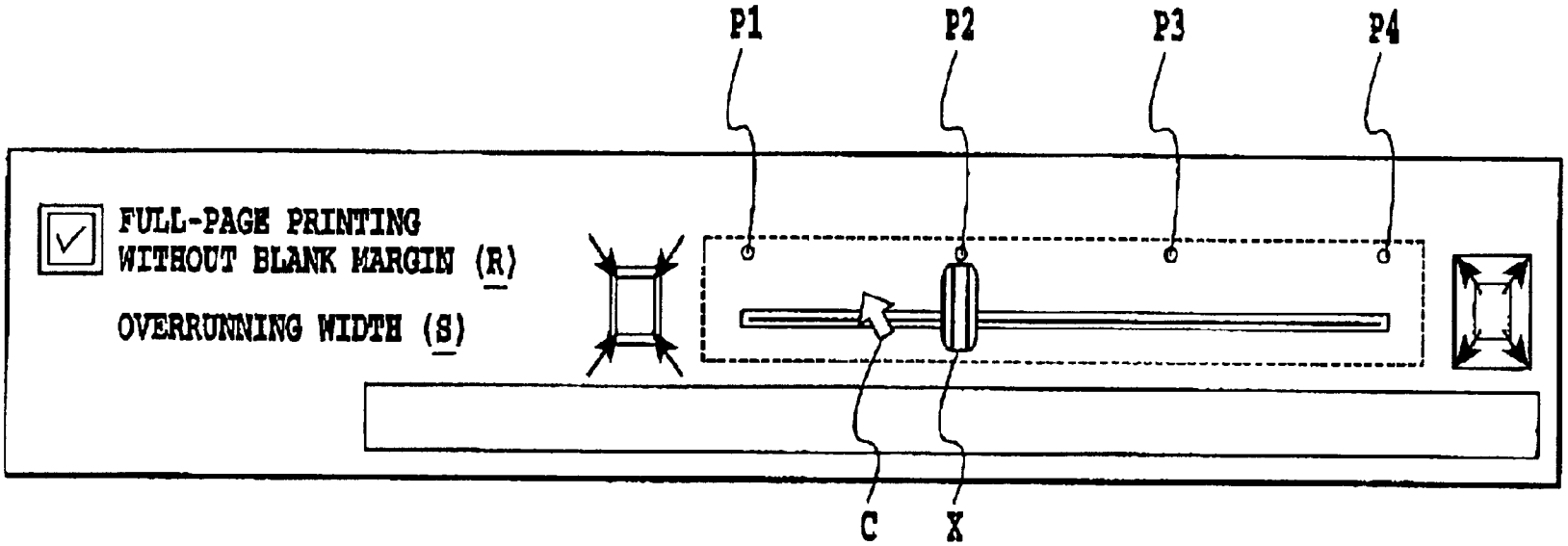

In this example, when the user moves a mouse pointer C into a dot-enclosed field for setting the overrunning width and clicks on the field, the overrunning width specification item changes into a setting item, turning the screen of FIG. 18B into a user interface screen of FIG. 18C as a printer-recommended overrunning width guide screen.

In the screen of FIG. 18C the printer-recommended overrunning width is shown with a recommendation message "Recommended setting is at right end; the overrunning width decreases as you drag the knob toward left." By dragging the knob K on the screen of FIG. 18C with the mouse pointer C to one of four positions P1, P2, P3 and P4, the overrunning width is selectively set to one of four levels (first to fourth level) which corresponds to the selected position of the knob K.

The size of print data is changed according to the overrunning width that was specified in this manner from among the four levels. Then, with the size of the print data changed, the overrunning area is also changed.

That is, as described earlier, the overrunning area S is given by.

Overrunning area S=Size of print data (width×length)−Size of the print medium (width×length).

Thus, changing the size of the print data causes the overrunning area S to be changed.

When the overrunning area S is changed, the amount of waste ink ejected in the overrunning area naturally changes. Therefore, when the overrunning width is adjusted to change the overrunning area S, it is preferred that the addend to be added to the counter as the waste ink volume be preferably changed accordingly. That is, the addend should preferably be determined in accordance with the changed overrunning area S. Considering that the overrunning area S is defined by the size of the print data and the size of the print medium, it follows therefore that the addend is preferably determined according to both the size of the print data and the size of the print medium.

Instead of using a constant predetermined value as the addend to be added for each marginless printing operation, this sixth embodiment uses a plurality of different predetermined values and selects one that matches the size of the print data and the size of the print medium for use with the addition operation. That is, the predetermined value to be added varies according to the size of the print data and the size of the print medium More specifically, upon receiving information on the size of the print data and the size of the print medium used, the ink jet printing apparatus references a table—which relates sizes of print data and sizes of print medium to their associated predetermined values—selects an appropriate predetermined value that matches the size of the print data and the size of the print medium specified by the received information on the print data size and print medium size used, and adds the selected predetermined value to the counter.

In this configuration, the waste ink volume information retrieving means retrieves a predetermined value corresponding to the print data size and the print medium size used and sends the predetermined value to the counter. The counter (addition means) then adds the predetermined value received to the existing value.

In the sixth embodiment described above, since the value (addend) to be added up for each marginless printing operation is determined by taking the size of print data and the size of print medium into consideration, a more precise waste ink volume management can be realized than when the addend is determined without considering the size of print data and the size of print medium.

(Other Embodiments)

In the first to sixth embodiments, a warning action has been described to be activated and also a printing operation stopped. This warning action and the stop control of the printing operation are preferably executed at the following timings. That is, the warning action is preferably executed when the accumulated value of waste ink volume determined by a waste ink volume accumulation means reaches a first regulating value which is smaller than the maximum ink absorption volume of the platen ink absorber. The stop control of the printing operation is preferably executed when the accumulated value of waste ink volume reaches a second regulating value which is equal to or less than the maximum ink absorption volume and larger than the first regulating value.

In the first to sixth embodiments, it is assumed that the waste ink produced by the marginless printing and the waste ink produced by the recovery operation are retained in separate ink absorbers. In this arrangement, all of the waste ink produced by the marginless printing at the ends of the print medium is absorbed and held by the ink absorber (platen ink absorber 13) independently provided in the platen 10. Therefore, only the waste ink volume ejected onto the platen ink absorber is taken into account in setting the addend (predetermined value), which is to be added for each marginless printing operation, and the absorption limit (regulating value) of the platen ink absorber. Further, the waste ink volume accumulating means for accumulating the waste ink volume, too, is used to total only the waste ink volume ejected onto the platen ink absorber. In more concrete terms, the waste ink volume accumulating means comprises: the waste ink volume information retrieving means, which retrieves information on the waste ink volume produced by one marginless printing operation (i.e., an addend to be added each time one marginless printing operation is executed) and sends this information to the counter; and the counter that accumulates the information (addend) transferred from the waste ink volume Information retrieving means. As described above, in the preceding embodiments, the waste ink volume management is realized solely by the platen ink absorber.

The present invention, however, is not limited to the above configuration, and may be applied to a configuration in which the waste ink produced by the recovery operation and the waste ink produced by the marginless printing are both retained in the ink absorber (waste ink absorber) that is originally intended to collect the waste ink produced by the recovery operation such as preliminary ejection and nozzle suction. A recovery operation means for performing the recovery operation, such as preliminary ejection and nozzle suction, to discharge ink from the print head is arranged at a position outside the printing area (e.g., at a home position).

Figure 19:
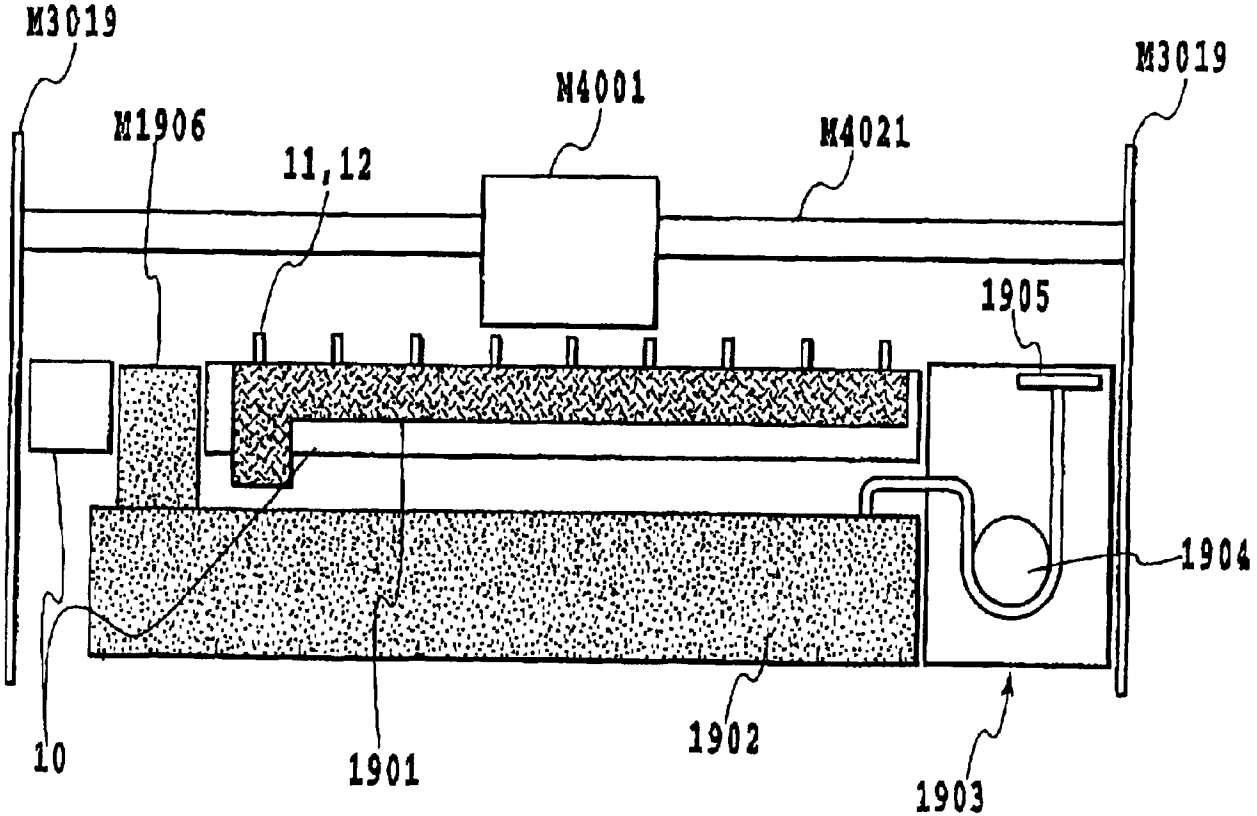
FIG. 19 illustrates a construction in which an ink absorber (waste ink absorber) for collecting a waste ink produced by the recovery operation is communicated with an ink absorber (platen ink absorber) for collecting a waste ink produced by the marginless printing.
Figure 15:
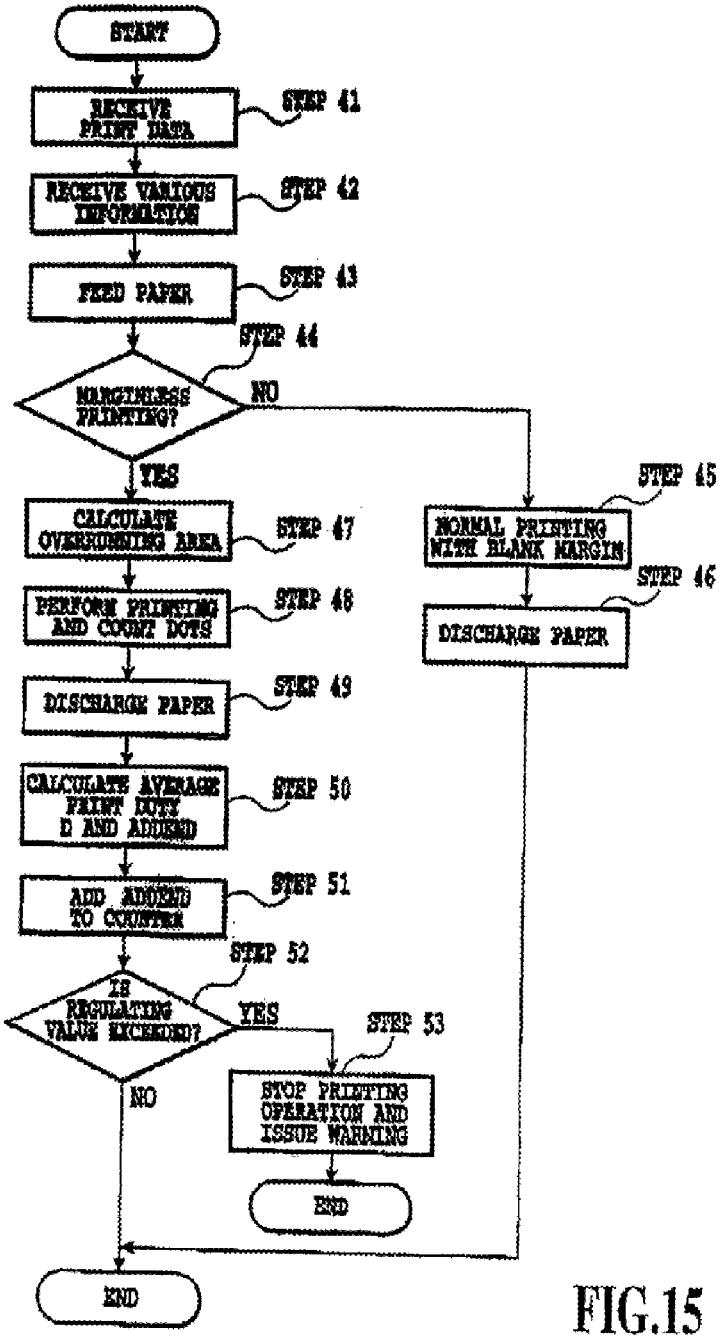

This configuration is illustrated in FIG. 19. As can be seen from FIG. 19, the waste ink produced by the marginless printing is first absorbed by the platen ink absorber 1901 from which it drips by gravity onto the waste ink absorber 1902. That is, the waste ink produced by the marginless printing is collected through the platen ink absorber 1901 to the waste ink absorber 1902 where it is held. The waste ink produced by the recovery operation is also held in the waste ink absorber 1902. Thus, in this arrangement, the waste ink from the marginless printing and the waste ink from the recovery operation are both held in the waste ink absorber 1902. As can be seen from the figure, the waste ink absorber 1902 is arranged, with respect to the gravity direction, below the platen ink absorber 1901 which is provided in the ink receiving portion.

In FIG. 19, reference number 1903 represents a recovery unit that performs the nozzle suction operation on the print head. The recovery unit 1903 includes a pump 1904 communicating with the waste ink absorber 1902 and a cap 1905 that hermetically covers the nozzle portion of the print head. Denoted 1906 is a preliminary ejection ink receiver that receives ink ejected from the print head during the preliminary ejection operation performed before the printing operation. The preliminary ejection ink receiver 1906 has an ink absorber made from, for example, sponge whose lower end is in contact with the waste ink absorber 1902.

In this configuration it is preferable to manage the waste ink volume in the waste ink absorber to which both the waste ink from the marginless printing and the waste ink from the recovery operation are collected. In that case, the regulating value defined as a threshold of ink overflow is set equal to the absorption limit of the waste ink absorber. Further, the sum of the waste ink volume produced by the marginless printing and the waste ink volume produced by the recovery operation represents the total amount of waste ink. Thus, a check is made to see if this sum is in excess of the regulating value. A warning is issued when the regulating value is exceeded.

In this configuration, the waste ink volume accumulating means is constructed to accumulate both the waste ink volume produced by the marginless printing and the waste ink volume produced by the recovery operation. In more detail, the waste ink volume information retrieving means that makes up the waste ink volume accumulating means retrieves information on the waste ink volume produced by the marginless printing (first value) and also information on the waste ink volume produced by the recovery operation (second value) and sends not only the first addend but a second addend to the counter. The counter is constructed to total not only the first addend but also the second addend.

This configuration (in which the waste ink from the marginless printing and the waste ink from the recovery operation are both retained in the waste ink absorber) is applicable to any of the first to sixth embodiment. In applying this configuration, the arrangement for managing the waste ink volume in the platen ink absorber needs only to be replaced with the arrangement for managing the waste ink volume in the waste ink absorber.

In applying the above configuration to the first embodiment, for example, the waste ink volume accumulating means adds the first predetermined value (first value) each time one marginless printing operation is executed and also adds the second predetermined value (second value) equivalent to the waste ink volume produced by the recovery operation each time the recovery operation is executed. In this way the waste ink volume from the marginless printing and the waste ink volume from the recovery operation are summed up to determine a total waste ink volume. Then it is checked whether the total waste ink volume is in excess of the regulating value (absorption limit of the waste ink absorber). If the regulating value is exceeded, a warning such as an annunciation prompting the user to perform maintenance service on the ink absorber is issued.

When the above configuration is applied to the second embodiment, the waste ink volume accumulating means adds up the first value corresponding to the size of the print medium each time one marginless printing operation is executed, and at the same time adds up the second value equivalent to the waste ink volume from the recovery operation each time the recovery operation is executed. In this way, the waste ink volume from the marginless printing and the waste ink volume from the recovery operation are summed up to determine the total waste ink volume. Then it is checked whether the total waste ink volume is in excess of the regulating value (absorption limit of the waste ink absorber). If the regulating value is exceeded, a warning such as an annunciation prompting the user to perform maintenance service on the ink absorber is issued.

When the above configuration is applied to the third embodiment, the waste ink volume accumulating means adds up the first value corresponding to the kind of print medium and the print mode each time one marginless printing operation is executed, and at the same time adds up the second value equivalent to the waste ink volume from the recovery operation each time the recovery operation is executed. In this way, the waste ink volume from the marginless printing and the waste ink volume from the recovery operation are summed up to determine the total waste ink volume. Then it is checked whether the total waste ink volume is in excess of the regulating value (absorption limit of the waste ink absorber). If the regulating value is exceeded, a warning such as an annunciation prompting the user to perform maintenance service on the ink absorber is issued.

When the above configuration is applied to the sixth embodiment, the waste ink volume accumulating means adds up the first value corresponding to the size of the print medium and the size of the print data each time one marginless printing operation is executed, and at the same time adds up the second value equivalent to the waste ink volume from the recovery operation each time the recovery operation is executed. In this way, the waste ink volume from the marginless printing and the waste ink volume from the recovery operation are summed up to determine the total waste ink volume. Then it is checked whether the total waste ink volume Is in excess of the regulating value (absorption limit of the waste ink absorber). If the regulating value is exceeded, a warning such as an annunciation prompting the user to perform maintenance service on the ink absorber is issued.

The applications to the fourth and fifth embodiments are similar to those explained above and their descriptions are omitted here.

The warning action indicating that the waste ink volume in the waste ink absorber is approaching its limit and the stop control of the printing operation are preferably executed at the following timings. That is, the warning action is preferably executed when the accumulated value of the waste ink volume determined by the waste ink volume accumulating means reaches the first regulating value which is smaller than the maximum ink absorption volume of the platen ink absorber. The stop control of the printing operation is preferably executed when the accumulated value of waste ink volume reaches a second regulating value which is equal to or less than the maximum ink absorption volume and larger than the first regulating value.

In the first to sixth embodiment, while the waste ink volume produced by each marginless printing operation is taken as an addend and accumulated in the counter, it is possible to use as an addend the waste ink volume produced by the marginless printing performed on a plurality of print mediums. That is, the waste ink volume produced by the marginless printing operations on a predetermined number of print mediums can be taken as an addend. It is also possible to use as an addend the waste ink volume produced by the marginless printing on a print area less than one page of print medium (e.g., one-half page or individual scan lines).

Further, in the first to sixth embodiment, while the waste ink management operation is executed by the printing apparatus body, the processing associated with the waste ink management may be executed on the host side. That is, various processing described above may be executed in the printer driver which then sends the print data and the overrunning ink volume to the printing apparatus. This arrangement can also produce the similar effects.

In the above embodiments, descriptions have concerned a case where printing is done without leaving blank margins at end portions (for example, four sides) of a print medium. It should be noted that the present invention is also applicable where an image is formed on a print medium with the marginless printing performed at only a part of end portions of the print medium, for example at only one side or a part of one side. In this specification, the marginless printing means a printing in which a portion with no blank margin exists at at least a part of end portions of the print medium.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus for performing marginless printing providing no margin on at least a part of end portions of a print medium supported on a platen by ejecting ink from a print head onto an overrunning area outside the at least a part of end portions of the print medium, comprising:

an ink receiver for receiving waste ink ejected onto the overrunning area during the marginless printing; and waste ink volume accumulating means for cumulatively adding a value corresponding to a volume of waste ink ejected to the ink receiver, wherein the waste ink volume accumulating means adds up a value corresponding to the volume of waste ink which is determined based on a kind of print medium selected from the kinds of print media corresponding to different ink absorption properties, a kind of marginless print mode selected from kinds of marginless print modes corresponding to different print speeds, a size of print data and a size of print medium used for the marginless printing, the size of print data being determined based on an overrunning width of the overrunning area specified from among a plurality of different overrunning widths.

2. An ink jet printing apparatus for performing marginless printing at end portions of a print medium supported on a platen by ejecting ink from a print head onto an overrunning area outside the end portions of the print medium, the ink jet printing apparatus comprising:

an ink receiver for receiving waste ink ejected onto the overrunning area; and waste ink volume accumulating means for cumulatively adding a value corresponding to a volume of waste ink ejected to the ink receiver during the marginless printing each time the marginless printing is executed, wherein the waste ink volume accumulating means adds up a first value corresponding to the volume of waste ink when a print mode used for the printing is a relatively fast first mode, and, when the print mode is a relatively slow second mode, adds up a second value corresponding to the volume of waste ink which is different from the first value.

3. An ink jet printing apparatus for performing marginless printing providing no margin on at least a part of end portions of a print medium supported on a platen by ejecting ink from a print head onto an overrunning area outside the at least a part of end portions of the print medium, comprising:

an ink receiver for receiving waste ink ejected onto the overrunning area during the marginless printing; and waste ink volume accumulating means for cumulatively adding a value corresponding to a volume of waste ink ejected to the ink receiver, wherein the waste ink volume accumulating means adds up a value corresponding to the volume of waste ink which is determined based on a size of print data and a size of print medium, the size of print data being determined based on an overrunning width of the overrunning area specified from among a plurality of different overrunning widths.

4. An ink jet printing apparatus as claimed in claim 3, wherein the ink receiver is provided in the platen arranged at a position opposing the print head.

5. An ink jet printing apparatus as claimed in claim 3, wherein the platen has a plurality of ribs protruding from an upper surface thereof to support the print medium, and the ink receiver is situated between the ribs and has an ink absorber for collecting waste ink ejected onto the overrunning area.

6. An inkjet printing apparatus as claimed in claim 3, wherein the ink receiver has an ink absorber for collecting the ejected waste ink, the ink jet printing apparatus further comprising:

control means for executing a warning action when a total value acquired by the waste ink volume accumulating means reaches a first regulating value smaller than a maximum ink absorption volume of the ink absorber and for executing a stop control of the printing operation when the total value reaches a second regulating value equal to or smaller than the maximum ink absorption volume of the ink absorber and larger than the first regulating value.

7. An ink jet printing apparatus as claimed in claim 6, further comprising:

recovery means for performing a recovery operation to discharge ink from the print head; and a waste ink absorber for collecting waste ink produced by the recovery operation of the recovery means, wherein the waste ink absorber is arranged, with respect to a gravity direction, below the ink absorber installed in the ink receiver, the waste ink ejected onto the ink absorber during the marginless printing moves to and is held by the waste ink absorber, and the waste ink volume accumulating means calculates a total of the waste ink volume in the waste ink absorber by summing a value corresponding to the waste ink volume ejected onto the ink receiver and a value corresponding to the waste ink volume produced by the recovery operation of the recovery means.

8. An ink jet printing apparatus as claimed in claim 3, further comprising:

recovery means for performing a recovery operation to discharge ink from the print head; and a waste ink absorber for collecting waste ink produced by the recovery operation of the recovery means, wherein the waste ink ejected onto the ink receiver is held in the waste ink absorber together with the waste ink produced by the recovery operation, and the waste ink volume accumulating means calculates a total of the waste ink volume in the waste ink absorber by summing a value corresponding to the waste ink volume ejected onto the ink receiver and a value corresponding to the waste ink volume produced by the recovery operation of the recovery means.

9. An ink jet printing apparatus as claimed in claim 8, further comprising:

control means for executing a warning action when a total value acquired by the waste ink volume accumulating means reaches a first regulating value smaller than a maximum ink absorption volume of the waste ink absorber and for executing a stop control of the printing operation when the total value reaches a second regulating value equal to or smaller than the maximum ink absorption volume and larger than the first regulating value.

10. An ink jet printing apparatus as claimed in claim 3, further comprising:

control means for performing control so that when a total value acquired by the waste ink volume accumulating means reaches a regulating value, a subsequent printing operation is stopped.

11. An ink jet printing method for printing using an ink jet printing apparatus for performing marginless printing providing no margin on at least a part of end portions of a print medium by ejecting ink from a print head based on print data representing a size which is larger than the size of a print medium to be printed, comprising the steps of:

specifying an overrunning width of the print data overrunning outwardly from the print medium to be printed from among a plurality of different overrunning widths for the print medium to be printed;

generating the print data based on the specified overrunning width;

performing the marginless printing based on the generated print data; and cumulatively adding a value corresponding to a volume of waste ink ejected to an ink receiver in the marginless printing, the ink receiver being provided for receiving the waste ink ejected to the outside of the print medium, wherein the value is determined based on a size of the generated print data and a size of the print medium to be printed, the size of the print data being generated based on the specified overrunning width among the plurality of different overrunning widths.

12. An ink jet printing method for printing using an ink jet printing apparatus for performing marginless printing providing no margin on at least a part of end portions of a print medium by ejecting ink from a print head based on print data representing a size which is larger than the size of a print medium to be printed, comprising the steps of:

specifying an overrunning width of the print data overrunning outwardly from the print medium to be printed from among a plurality of different overrunning widths for the print medium to be printed;

generating the print data based on the specified overrunning width;

performing the marginless printing based on the generated print data; and cumulatively adding a value corresponding to a volume of waste ink ejected to an ink receiver in the marginless printing, the ink receiver being provided for receiving the waste ink ejected to the outside of the print medium, wherein the value is determined based on a kind of print medium to be printed, a kind of marginless print mode to be used, a size of the generated print data and a size of print medium to be printed, the size of print data being determined based on an overrunning width specified from among the plurality of different overrunning widths.

* * * * *

UNITED STATES PATENT AND TRADEMARK OFFICE

CERTIFICATE OF CORRECTION

PATENT NO. : 7,011,389 B2
APPLICATION NO. : 10/214106
DATED : March 14, 2006
INVENTOR(S) : Tetsuya Edamura et al.

It is certified that error appears in the above-identified patent and that said Letters Patent is hereby corrected as shown below:

On the Title Page
[56] REFERENCES CITED:

FOREIGN PRIORITY DOCUMENTS, "EP 1 000 754 5/1700" should read --EP 1 000 754 05/2000--.

SHEET 17:

FIG. 15, "ADDED" should read --ADDEND--. (see attached)

COLUMN 1:

Line 13, "printing-apparatus" should read --printing apparatus--.
Line 37, "done-to" should read --done to--.

COLUMN 2:

Line 14, "apparatus" should read --apparatus.--.

COLUMN 4:

Line 19, "cased" should read --caused--.

COLUMN 6:

Line 12, "thereof" should read --¶ The discharge tray M1004 has one end portion thereof--.

COLUMN 7:

Line 1, "tion" should read --tion.--.
Line 36, "wires" should read --wires'--.
Line 54, "1100," should read --H1100,--.

COLUMN 8:

Line 48, "light" should read --light.--.

UNITED STATES PATENT AND TRADEMARK OFFICE

CERTIFICATE OF CORRECTION

PATENT NO. : 7,011,389 B2
APPLICATION NO. : 10/214106
DATED : March 14, 2006
INVENTOR(S) : Tetsuya Edamura et al.

It is certified that error appears in the above-identified patent and that said Letters Patent is hereby corrected as shown below:

COLUMN 9:

Line 48, “E101B,” should read --E1018,--.
Line 66, “B1006” should read --E1006--.

COLUMN 11:

Line 16, “B2032” should read --E2032--.
Line 22, “Such” should read --such--.
Line 38, “B2038,” should read --E2038,--.

COLUMN 12:

Line 51, “B2018” should read --E2018--.
Line 54, “B2025” should read --E2025--.

COLUMN 14:

Line 59, “at, positions” should read --at positions--.

COLUMN 16:

Line 1, “predetermined values” should read --“predetermined value”--.
Line 32, “values” should read --value--.

COLUMN 17:

Line 2, “ment.” should read --ment,--.

COLUMN 18:

Line 19, “($mm^2$)” should read --S($mm^2$)--.
Line 29, “($mm^2$)” should read --S($mm^2$)--.

COLUMN 19:

Line 51, “values”” should read --value”--.

UNITED STATES PATENT AND TRADEMARK OFFICE

CERTIFICATE OF CORRECTION

PATENT NO. : 7,011,389 B2
APPLICATION NO. : 10/214106
DATED : March 14, 2006
INVENTOR(S) : Tetsuya Edamura et al.

It is certified that error appears in the above-identified patent and that said Letters Patent is hereby corrected as shown below:

COLUMN 20:

Line 58, “values”” should read --value”--.

COLUMN 22:

Line 39, “than-the” should read --than the--.
Line 54, “Table 2” should read --Table 2,--.

COLUMN 23:

Line 50, “widthxprint” should read --widthxPrint--.

COLUMN 25:

Line 9, “mode.” should read --mode,--.
Line 60, “stop 44” should read --step 44--.

COLUMN 26:

Line 48, “print-duty” should read --print duty--.

COLUMN 27:

Line 15, “width in” should read --width. In--.
Line 46, “by.” should read --by--.

COLUMN 28:

Line 4, “medium” should read --medium.--.
Line 64, “Information” should read --information--.

COLUMN 30:

Line 60, “Is” should read --is--.

UNITED STATES PATENT AND TRADEMARK OFFICE

CERTIFICATE OF CORRECTION

PATENT NO. : 7,011,389 B2
APPLICATION NO. : 10/214106
DATED : March 14, 2006
INVENTOR(S) : Tetsuya Edamura et al.

It is certified that error appears in the above-identified patent and that said Letters Patent is hereby corrected as shown below:

COLUMN 32:

Line 54, "inkjet" should read --ink jet--.

Signed and Sealed this

Fifth Day of December, 2006

JON W. DUDAS
*Director of the United States Patent and Trademark Office*